US005710386A

United States Patent [19]

Abe

[11] Patent Number: 5,710,386

[45] Date of Patent: Jan. 20, 1998

[54] METHOD AND APPARATUS FOR EFFICIENTLY CONTROLLING ACCESS TO STORED OPERATION CONTROL DATA AND TONE FORMING DATA

[75] Inventor: Yasunao Abe, Hamamatsu, Japan

[73] Assignee: Yamaha Corporation, Japan

[21] Appl. No.: 887

[22] Filed: Jan. 5, 1993

[30] Foreign Application Priority Data

Jan. 8, 1992 [JP] Japan ..... 4-19567

[51] Int. Cl.[6] ..... G10H 7/00

[52] U.S. Cl. ..... 84/602

[58] Field of Search ..... 84/601–604, 609

[56] References Cited

U.S. PATENT DOCUMENTS

| | | | |
|---|---|---|---|
| 5,094,136 | 3/1992 | Kudo et al. | 84/603 |
| 5,095,800 | 3/1992 | Matsuda | 84/618 |
| 5,245,126 | 9/1993 | Saito et al. | 84/604 |
| 5,248,842 | 9/1993 | Saito | 84/602 |
| 5,300,725 | 4/1994 | Manabe | 84/609 |

*Primary Examiner*—William M. Shoop, Jr.
*Assistant Examiner*—Jeffrey W. Donels
*Attorney, Agent, or Firm*—Graham & James LLP

[57] ABSTRACT

In such an application where one memory stores both tone forming data and operation controlling data and the memory is selectively accessed from separate devices utilizing the respective data, a control section utilizing the operation controlling data normally has access to the memory. When it is desired to read out the tone forming data from the memory, a utilization-request signal is generated from a tone source section. When the utilization-request signal is generated, the tone source section is allowed to access the memory only for a time necessary to read out the tone forming data. Accordingly, the memory accessing times for the control section and tone source section are not fixed and thus access to the memory can be made in a flexible manner. Particularly, access to the memory by the control section (having a computer, for instance) utilizing the operation control data can be done with a highly enhanced efficiency, and thus, as a whole, efficient memory access without waste can be achieved.

17 Claims, 9 Drawing Sheets

METHOD AND APPARATUS FOR EFFICIENTLY CONTROLLING ACCESS TO STORED OPERATION CONTROL DATA AND TONE FORMING DATA

BACKGROUND OF THE INVENTION

The present invention generally relates to an electronic musical instrument in which selective access to a memory storing both operation controlling data and tone forming data can be made via a common bus from separate devices that utilize the respective data, and more particularly it relates to an improved memory access used for such a purpose.

A technique is known in which both tone forming data (such as waveform sample data) and operation controlling data (such as program data for a computer) are stored in a common memory, and access to the memory is made via a common bus selectively from separate devices (such as a tone generating device that utilizes the waveform sample data and a computer device that utilizes the program data). According to this prior technique, fixed time division slots for memory access are allocated to the respective devices or systems. For instance, predetermined time division slots are fixedly allocated in correspondence with a plurality of tone generation channels in the tone generating device and predetermined time division slots are also fixedly allocated to the computer device in such a manner that access to the common memory can be made only at the allocated time slots.

Thus, even when any tone is not assigned to a certain tone generation channel, the predetermined time slots are automatically allocated to the channel although it is actually not necessary for the channel to access and utilize the memory for tone generation, which results in a substantial waste of time. Particularly, with the computer device, the address processing rate can not be increased because it can only utilize the predetermined time slots fixedly allocated in advance. This is diadvantageous in that the program execution rate tends to be undesirably low.

Generally, electronic musical instruments of a higher grade are provided with a larger number of tone generation channels in order to increase the number of tones that can be simultaneously generated. But, ordinarily, not many of the tone generation channels, on the average, are simultaneously utilized. Therefore, many of the memory-accessing time division slots for the tone generation channels are wasted, despite the fact that the memory-accessing time division slots available to the computer device are always limited to a considerable degree. This presents a contradictory problem that the execution rate by the computer tends to be extremely poor and hence a heavy burden is imposed on the computer.

SUMMARY OF THE INVENTION

It is therefore an object of the present invention to provide an electronic musical instrument which allows an unwasteful efficient memory access, in such an application where a memory storing tone forming data and operation controlling data is accessed via a common bus selectively from separate devices utilizing the respective data.

It is another object of the present invention to provide an electronic musical instrument which allows an unwasteful efficient memory access, in such an application where there are provided at least two tone synthesizing or controlling systems that operate independently of each other and a memory for storing data in correspondence to the systems for use in the respective systems.

An electronic musical instrument according to the present invention comprises a storage section for storing tone forming data and operation controlling data, a control section for reading out the operation controlling data to control an operation of circuitry on the basis thereof, a tone source section for reading out the tone forming data to form a tone signal on the basis thereof, a request signal generating section for causing a utilization-request signal to be generated from the tone source section when the tone forming data is needed, and an access control section for normally allowing the control section to access the storage section, and allowing, when the utilization-request signal is given, the tone source section to access the storage section only for a time necessary to read out the tone forming data.

In this electronic musical instrument, a utilization-request signal is generated by the request signal generating section when the tone source section section needs the tone forming data stored in the storage or memory section. The access control section normally allows the control section to access the storage section but, when the utilization-request signal is given, it allows the tone source section to access the storage section only for a time necessary to read out the tone forming data. Accordingly, the memory accessing time is not fixed and thus memory access can be made in a flexible manner. Particularly, the control section (comprising a computer, for instance) normally has priority to access the memory, and gives the memory access to the tone source section only when the utilization-request signal is generated from the tone source section. The utilization-request signal is generated for example when a tone is assigned to a tone generation channel, but no tone forming data is needed when it is not necessary to generate a tone at the tone generation channel. Therefore, as for the tone generation channel to which no tone is assigned, no utilization signal is generated. Consequently, on the average, memory access by the control section can be done with a highly enhanced efficiency, and thus efficient memory access without waste, as a whole, can be effectively achieved.

As one specific embodiment of the above-mentioned electronic musical instrument, the request signal generating section may cause the utilization-request signal to be generated from the tone source section during a sample time for forming tone signal sample data, when it is necessary to form the tone signal. The time necessary to read out the tone forming data may be a part of one such sample time. The access control section may, during a sample time when the utilization-request signal is given, allow the tone source section to access the storage section only for the part of the time which is necessary to read out the tone forming data and may allow the control section to access the storage section for a remaining part of the time. With this arrangement, it is made possible to allow the tone source section to access the storage section only for a minimum time within one sample time and allow the control section to access the storage section for a remaining part of the time, with the result that efficient memory access without waste, as a whole, can be achieved.

As another specific embodiment of the above-mentioned electronic musical instrument, the tone source section may be capable of generating tone signals independently in respective ones of plural tone generation channel, and different readout times may be assigned, as a time to read out the tone forming data, to the respective tone generation channels. The request signal generating section may generate the utilization-request signal during the assigned readout time of the tone generation channel where it is necessary to form a tone signal. The time necessary to read out the tone forming data may be a part of the assigned readout time, and the access control section may, during the assigned readout time of the tone generation channel to which the utilization-request signal has been given, allow the tone source section to access the storage section only for a time necessary to read out the tone forming data and allow the control section to access the storage section for a remaining part of the time. With this arrangement, it is also made possible to allow the tone source section to access the storage Section only for a minimum time within one sample time and allow the control section to access the storage section for the remaining part of the time, so that efficient memory access without waste can be achieved.

In still another specific embodiment of the above-mentioned electronic musical instrument, there may further be provided a utilization-enable signal generating section for generating a utilization-enable signal indicating that the tone source section can utilize the storage section, when the control section dose not access the storage section. The access control section may, if the utilization-request signal is given when the utilization-enable signal is not being generated, allow the tone source section to access the storage section only for a time necessary to read out the tone forming data, during which time it may disable the control section from accessing the storage section.

An electronic musical instrument according to another aspect of the present invention comprises at least two tone synthesizing or controlling systems that operate independently of each other, a storage section for storing data in correspondence to the systems for use in the respective systems, a section for, when predetermined one of the systems dose not access the storage section, generating a utilization-enable signal indicating that the other of the systems can access the storage section, a section for generating a utilization-request signal when the other of the systems wants to access the storage section, and an access control section for allowing the predetermined one of the systems to access the storage section when the utilization-enable signal is not being given from the one of the systems, and allowing the other of the systems to access the storage section when the utilization-enable signal is given from the predetermined one of the systems, and allowing, if the utilization-request signal is given when the utilization-enable signal is not being generated, the other of the systems which has given the utilization-request signal to access the storage section only for a time necessary to read out the data, during which time the access control section disables the predetermined one of the systems from accessing the storage section.

In this electronic musical instrument, when the predetermined one of the plural systems dose not access the storage section, there is generated a utilization-enable signal indicating that the other of the systems can access the storage section. When, on the other hand, the other of the systems wants to access the storage section, a utilization-request signal is generated. The access control section allows the predetermined one of the systems to access the storage section when the utilization-enable signal is not given from the one of the systems, and it allows the other of the systems to access the storage section when the utilization-enable signal has been given from the predetermined one of the systems. When the utilization-request signal has been given when the utilization-enable signal is not being generated, the access control section allows the other of the systems which has given the utilization-request signal to access the storage section only for a time necessary to read out the data, during which time the access control section disables the predetermined one of the systems from accessing the storage section. With this arrangement, the predetermined one system has priority to access the memory, and the other system is allowed to access the memory only when it requests to do so. Consequently, efficiency of the memory access by the predetermined one system can be markedly enhanced, and efficient memory access without waste can be achieved. As the predetermined one system, such a system may be chosen which requires a high memory access efficiency.

An electronic musical instrument according to still another aspect of the present invention comprises at least two tone synthesizing or controlling systems that operate independently of each other, a storage section for storing data in correspondence to the systems for use in the respective systems, a section for generating a utilization-request signal when the systems want to access the storage section, and an access control section for, on the basis of the utilization-request signal, allowing one of the systems to access the storage section in accordance with a predetermined priority standard.

In this electronic musical instrument, there is generated a utilization-request signal from each of the systems when the system wants to access the storage section. On the basis of the utilization-request signal, the access control section allows one of the systems to access the storage section in accordance with a predetermined priority standard. This priority standard may be any suitable standards. The access control section, for example, normally gives the one system priority to access the storage means, but allows the other system to access the storage section when there is given a utilization-request signal from the other system. By determining the priority standard in such a manner to normally give priority to the system requiring a high memory access efficiency, efficient memory access without waste can be achieved.

A waveform generating device according to the present invention comprises a storage section storing waveform data at plural addresses, an address generating section for generating start address setting data instructing a predetermined start address and end address setting data instructing a predetermined end address, at least one of the start address setting data and the end address setting data being value data containing decimal fraction data, a reading section for repeatedly reading out the waveform data from the storage section within a range from the start address corresponding to a start address setting data to the end address corresponding to an end address setting data, and an interpolation section for, upon reading out the waveform data from the address corresponding to the address setting data containing the decimal fraction data, interpolating between the read out waveform data in accordance with the decimal fraction data so as to obtain waveform data corresponding to the address setting data containing the decimal fraction data.

In this waveform generating device, even if at least one of the start address setting data and the end address setting data is value data containing decimal fraction data, it is made possible by means of interpolation to obtain waveform data accurately corresponding to the address setting data containing decimal fraction data. Since at least one of the start address setting data and the end address setting data is value data containing decimal fraction data, it is advantageously made possible, by the start address setting data and the end address setting data, to choose a point which will realize a smooth waveform link in repeated readout of the waveform data.

The preferred embodiments will now be described in greater detail with reference to the accompanying drawings.

DETAILED DESCRIPTION OF THE PREFERRED EMBODIMENTS

Figure 1:
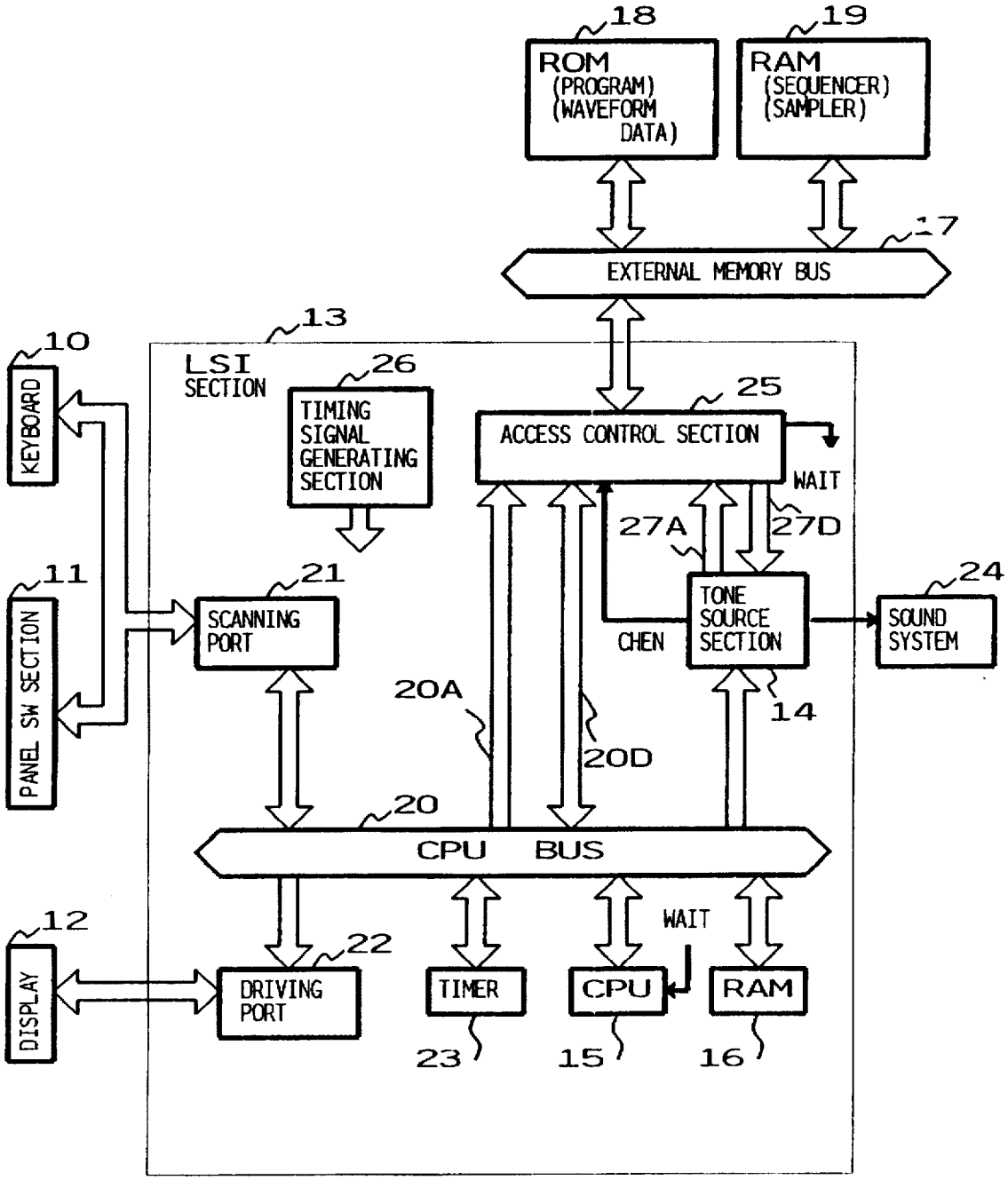
FIG. 1 is a block diagram illustrating an overall hardware structure of an electronic musical instrument according to an embodiment of the present invention.

FIG. 1 is a block diagram illustrating an overall hardware structure of the electronic musical instrument according to an embodiment of the present invention. A keyboard 10 includes a plurality of keys for instructing generation of scale tones, i.e., tones of various pitches. A panel switch section 11 includes a group of switches and other forms of operating members or operators that are provided on the operation panel for selecting or setting tone color, tone volume and musical effect etc. A display section 12 is composed of various displays provided on the operation panel.

A LSI section 13 is a large scale integrated circuit realizing the center of the electronic musical instrument which comprises a tone generating or tone source section 14, a CPU (central processing unit of a microcomputer) 15 constituting the center of the control system and a RAM (random access memory) 16.

To this LSI section 13 is connected an external memory via an external memory bus 17. As an example of such an external memory, a ROM (read-only memory) 18 is connected to the bus 17 in this embodiment. In this ROM 18, both tone forming data and operation controlling data are stored. As the tone forming data, a multiplicity of waveform sample data corresponding to plural kinds of waveforms, for example, are stored in a predetermined address area of the ROM 18. As the operation controlling data, program to be executed by the CPU 15 are stored in another predetermined address area of the ROM 18. Of course, other data than the above-mentioned may be stored in the ROM 18. Further, as an optional external memory, RAM 19 may be connected to the bus 17; in such a case, there may be stored in the RAM 19 such data as sequencer data (namely, automatic performance data), waveform data sampled from outside by means of an unillustrated microphone, and/or various other data.

The CPU 15 reads out the program from the ROM 18, on the basis of which it executes various processes to control the operations of the respective circuits. A RAM 16 functions as a data and working memory. Among various processes executed by the CPU 15 are typically a scanning process for a key depression/release detection, a tone generation assignment process responsive to the scanning process (namely, a key assignment process for assigning tone generation of a depressed key to any of tone generation channels of the tone source section 14), a scanning process for detecting actuation of the switches and other operators on the panel switch section 11, a display control process for the display section 12 etc. To enable these processes, the keyboard 10 and the panel switch section 11 are connected via a scanning port 21 to a CPU bus 20, and the display 12 is also connected via a driving port 22 to the CPU bus 20. A timer 23 which is also connected to the CPU bus 20 generates interrupt signal and other necessary timer signals.

As known in the art, the tone source section 14, which generates tone signal corresponding to a depressed key on the keyboard 10, is capable of generating, in its plural tone generation channels, plural tone signals corresponding to different scale tones. Under the control of the CPU 15, various parameter data for forming tones assigned to the individual channels (such as tone pitch data, touch data, tone volume setting/controlling data, envelope setting data, tone color setting/controlling data, waveform selecting data, setting/controlling data for various effects) are given via the CPU bus 20 to the tone source section 14. The tone source section 14, on the basis of these parameter data given, forms tone signal for each tone generation channel independently of the other channels. In this embodiment, it is assumed that the tone source section 14 has sixteen tone generation channels and tone signals are generated in these sixteen channels on a time divisional basis. Tone formation or tone synthesis technique employed in the tone source section 14 may be any of the memory readout type, frequency modulation type, harmonic synthesis type and other suitable types; however, in this embodiment, an example is shown in which waveform sample data stored in the ROM 18 are read out and then subjected to a waveform sample interpolation process to form tone signal sample data. Tone signals generated by the tone source section 14 are acoustically reproduced through a sound system 24.

The CPU 15 generates address signal for reading out the program from the ROM 18 and gives the generated address signal to an access control section 25. In the case where the optional external RAM 19 is connected, the CPU 15 also generates address signal for designating write/read address of the RAM 19 and gives the address signal to the access control section 25 via the CPU bus 20.

The access control section 25 performs a control such that either of the CPU 15 and the tone source section 14 is selected to access the external memory bus 17 (hence the external memory, ROM 18 or RAM 19). The data and address buses of the external memory are connected to the selected device (one of the CPU 15 and the tone source section 14) so that the external memory can be utilized for reading (or writing).

When it is necessary to read out waveform sample data from the external memory, the tone source section 14 generates utilization-request signal. According to this embodiment, the utilization-request signal is channel-enable signal CHEN. The channel-enable signal CHEN becomes "1" at a time divisional process timing of a channel being actually utilized for tone signal generation, to thereby indicate that utilization of the external memory is being requested for that channel.

Control performed by the access control section 25 will be outlined below. The access control section 25 performs a control such that the CPU 15 normally has preferential access to the external memory, and that, when the above mentioned utilization-request signal is given, i.e., the channel enable signal CHEN is "1", the tone source section 14 is given access to the external memory (ROM 18) only for a time necessary to read out the waveform sample data therefrom. In the embodiment to be detailed later, the access control section 25 detects when the CPU 15 has requested access to the external memory 15, to generate CPU-access-request signal OMEN. When, on the other hand, the CPU 15 does not request access to the external memory, the access control section 25 generates tone-source-utilization-enable signal $\overline{\text{OMEN}}$ (the bar mark "" indicates inversion and thus this signal represents an invert of the CPU-access-request signal OMEN). Therefore, if utilization-request signal is given when tone-source-utilization-enable signal $\overline{\text{OMEN}}$ is being generated, the tone source section 14 can freely access the external memory.

If, on the other hand, utilization-request signal is given when tone-source-utilization-enable signal $\overline{\text{OMEN}}$ is not being generated, the tone source section 14 is allowed to access the external memory only for a time necessary to read out waveform sample data therefrom. During this time, the CPU 15 is disabled from accessing the external memory. Signal instructing such a disablement of the CPU 15 is a WAIT signal that is given from the access control section 25 to the CPU 15. When the WAIT signal becomes "1", the CPU 15 temporarily interrupts its access to the external memory and holds the then address to suspend the program execution until the WAIT signal again becomes "0". Namely, the CPU 15 temporarily interrupts the execution of the program step.

A timing signal generating section 26 generates and supplies clock pulses and timing signals that are needed in various circuits within the LSI section 13.

Next, with reference to FIG. 2, description will be made on timing relationships of major processes taking place in this embodiment. A unit access time to the external memory, i.e., ROM 18 is established to be synchronous with one cycle of clock pulse signal $\phi$; that is, address signal is sent out from the CPU 15 or the tone source section 14 to the external memory in synchronism with one cycle of the clock pulse signal $\phi$. In the tone source section 14, tone signal forming processes are carried out in sixteen channels on a time divisional basis, using twelve cycles of the clock pulse signal $\phi$ as a unit time division slot for one channel (see "channel slot" in FIG. 2). For convenience, the twelve subslots each corresponding to one cycle of the clock pulse signal $\phi$ and collectively making up one channel slot will hereinafter be referred to as "process slots 0–11". Timing signal T0 is generated (becomes "1") at process slot 0 of each channel slot. Timing signal T11 is generated (becomes "1") at process slot 11 of each channel slot.

Figure 2:
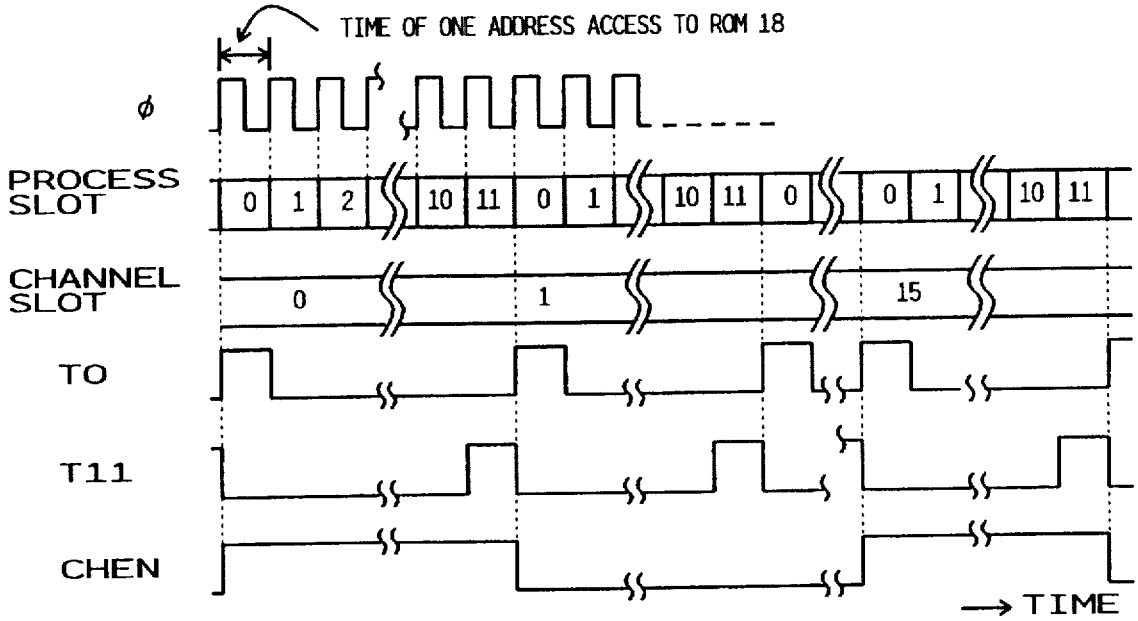
FIG. 2 is a timing chart illustrating timings of major operations carried out in the embodiment.

FIG. 2 also illustrates by way of example how the above-mentioned utilization-request signal, i.e., channel—enable signal CHEN is generated. In this illustrated example, utilization-request signal is generated (namely, channel-enable signal CHEN becomes "1") in correspondence to channel 0 and channel 15. Further, in this illustrated example, no utilization-request signal is generated (namely, channel-enable signal CHEN is "0") for channel 1. In this case, at all process slots corresponding to channel 1 , i.e., twelve process slots 0–11, the CPU 15 is allowed to access the external memory. As for the other channels for which utilization-request signal is generated (namely, channel-enable signal CHEN is "1"), not all of process slots 0–11 but only necessary number (in this embodiment, four) of process slots 0–11 are utilized for the tone source section 14 to access the external memory. At the other or remaining process slots not utilized for the tone source section 14 to access the external memory, the CPU 15 is allowed to access the external memory.

Next, an example detailed structure of the access control section 25 will be described with reference to FIG. 3.

Figure 3:
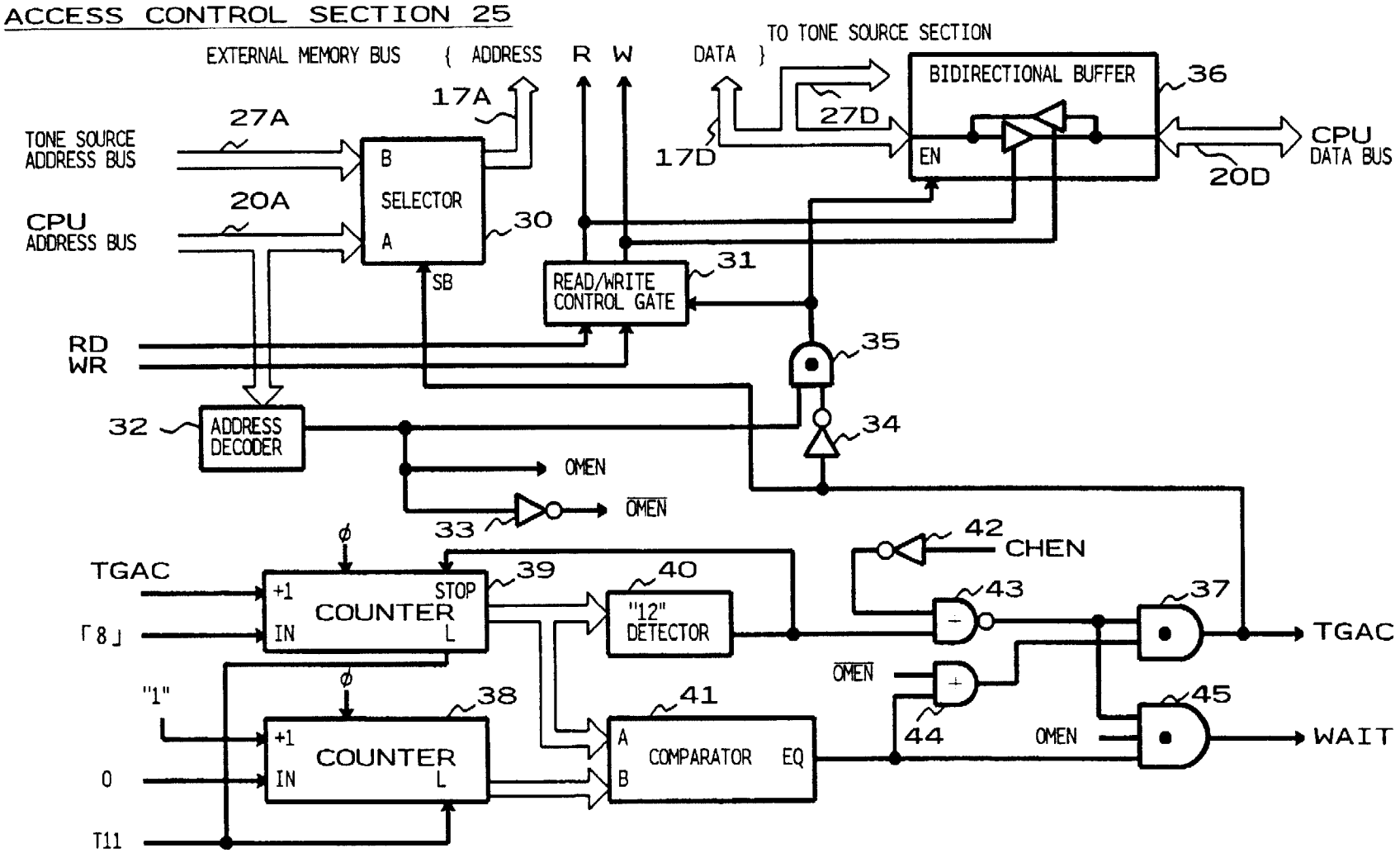
FIG. 3 is a block diagram illustrating an example detailed structure of the access control section shown in FIG. 1.

In the illustrated example of FIG. 3, address signal on an address bus 20A of the CPU 15 is provided to A input of an address selector 30, and address signal on an address bus 27A of the tone source section 14 is provided to B input of the address selector 30. To B selection control input SB of the selector 30, later-described tone-source-access signal TGAC is provided from an AND gate 37. This signal TGAC becomes "1" only when the tone source 14 is given access to the external memory, in order to cause the address signal on the address bus 27A to be selected by the selector 30. In the other, i.e., normal cases, the tone-source-access signal TGAC remains at "0" and so the selector 30 selects the address signal on the address bus 20A. Output of the selector 30 is coupled to an address bus 17A of the external memory bus 17, so that the address signal selected by the address selector 30 is delivered to address input of the external memory (ROM 18 or RAM 19).

External memory read command signal RD and external memory write command signal WR given from the CPU 15 via the CPU bus 20 are supplied to a read/write control gate 31. These command signals RD, WR indicate whether the CPU 15 should access the external memory for reading or writing purpose. As may be apparent, only the read command signal RD is supplied to access the ROM 18, and either the read command signal RD or the write command signal WR is supplied to access the RAM 19.

An address decoder 32, which serves to decode the address signal on the address bus 20A, outputs signal "1" as one-bit decoder output data when the address signal on the address bus 20A indicates an address of the external memory. Therefore, when the CPU 15 is accessing the external memory, the decoder 32 outputs signal "1" which is given to other circuits as CPU-access-request signal OMEN. When, on the other hand, the CPU 15 is not accessing the external memory, the decoder 32 outputs signal "0" which indicates that the external memory is utilizable by the tone source section 14. An inverter 33 inverts the output signal of the decoder 32. Therefore, when the inverted signal obtained by inverting the output signal of the decoder 32 through an inverter 33 is "1", it is indicated that the external memory is utilizable by the tone source section 14. The inverted output signal of the inverter 33 is given to other circuits as tone-source-utilization-enable signal $\overline{\text{OMEN}}$. Thus, this signal corresponds to utilization-enable signal indicating that the external memory is utilizable by the tone source section 14.

Invert of the tone-source-access signal TGAC outputted from an inverter 34 and the CPU-access-request signal OMEN are applied to an AND gate 35, so that the read/write control gate 31 is controlled by output signal of the AND gate 35. The AND gate 35 outputs a logic "1" when the CPU-access-request signal OMEN is "1" and the tone-source-access signal TGAC is "0" namely when the CPU 15 accesses the external memory. As described later, when the CPU-access-request signal OMEN is "1" and the tone-source-access signal TGAC is "1", it may happen that WAIT signal is generated to place the access action of the CPU 15 into a wait state. Therefore, the condition that the tone-source-access signal TGAC is "0" must absolutely be met.

When the output signal of the AND gate 35 is "1", the read/write control gate 31 directly outputs the external memory read command signal RD and external memory write command signal WR provided from the CPU 15, to the external memory bus 17 as read command R and write command W, respectively. When, on the other hand, the output signal of the AND gate 35 is "0", the read/write control gate 31 makes the read command R normally "1" to place the external memory into a read-only mode. This is because the tone source section 14 accesses the external memory only for reading purposes.

Data bus 17D of the external memory bus 17 is directly connected to data bus 27D of the tone source section 14 and is also connected via bi-directional buffer 36 to data bus 20D of the CPU bus 20. When the output signal of the AND gate 35 is "1", the bi-directional buffer 36 becomes operative so as to switch the direction of data flow between the data bus 17D on the external memory side and the data bus 20D on the CPU side. As for the data 27D of the tone source section 14, such a direction switch is not necessary because data flow is only in a single direction (only in a reading direction).

In this embodiment, in order to form one tone signal sample data, the tone source section 14 reads out two samples of the waveform sample data stored in the ROM 18 and then interpolates between the read out two samples. For example, data size of such data stored at each address of the ROM 18 is one byte (=eight bits), and data size of one sample of waveform sample data stored is twelve bits. Accordingly, in order to read out one sample of waveform sample data from the ROM 18, it is necessary to read two addresses of the ROM 18. Further, because two samples of waveform sample data must be read out for subsequent interpolation, it is necessary to read a total of four addresses in order to form one sample of tone signal sample data. Therefore, a total time required for the tone source section 14 to access the external memory is four access times which correspond to four process slots.

When utilization-request signal CHEN is given from the tone source section 14 during a certain channel slot, the access control section 25, as fully described later, performs a control such that four of twelve process slots contained in the channel slot are reserved for access by the tone source section 14.

Each of preset-type counters 38, 39 is responsive to the rising edge of the timing signal T11 for presetting therein initial data which is received at its input IN. Numerical value of "0" is preset into the counter 38, which then increments its count by one each time the clock pulse $\phi$ is given. Therefore, this counter 38 shows count values corresponding to process slots 0–11 contained in one channel slot.

Numerical value of "8" is preset into the counter 39, which then increments its count by one in synchronism with the clock pulse $\phi$ each time the tone-source-access signal TGAC is output from the AND gate 37; that is, the counter 39 sequentially increments its count each time the tone source section 14 makes one access to the external memory. When the tone source section 14 has accessed the external memory a predetermined number of times, i.e., four times, the counter 39 shows a count of "12". A "12" detector 40 is provided for detecting when the count of the counter 39 has become "12". Upon such a detection, the detector 40 outputs signal "1", in response to which the counter 39 is caused to stop its counting action.

A comparator 41 makes a comparison between the respective counts of the counters 38, 39. When the number of the remaining process slots of the channel slot in question becomes identical with the number of the unprocessed tone-source-access slots, both the counts of the counters 38, 39 coincide with each other, and coincidence output EQ of the comparator 41 becomes "1" in response to which tone-source-access signal TGAC is generated in a compulsory manner as more fully described later.

Tone-source-utilization-request signal, i.e., channel-enable signal CHEN is inverted by an inverter 42, then further inverted by a NOR gate 43 and thence applied to one input of the AND gate 37. Tone-source-utilization-enable signal $\overline{\text{OMEN}}$ given via the inverter 33 from the address decoder 32 is applied via an OR gate 44 to the other input of the AND gate 37. Also, the coincidence output EQ of the comparator 41 is applied through the OR gate 44 to the other input of the AND gate 37.

In this way, when the channel in question is requesting access to the external memory, signal CHEN of "1" causes "1" to be given from the NOR gate 43 to the AND gate 37, so that the AND gate 37 can generate tone-source-access signal TGAC during process slots 0–11 of the channel. Then, when the tone-source-utilization-enable signal $\overline{\text{OMEN}}$ becomes "1" during a process slot when no access is made from the CPU 15 to the external memory, "1" is output from the OR gate 44 to the AND gate 37. In response to this, output of the AND gate 37 becomes "1" to generate the tone-source-access signal TGAC.

In response to "1" of the tone-source-access signal TGAC, the selector 30, as mentioned earlier, connects the address bus 27A of the tone source section 14 to the address bus 17A of the external memory so as to enable the tone source section 14 to access the external memory. As more fully described later, the tone-source-access signal TGAC is also supplied to the tone source section 14 in which it is used for various controls in accessing the external memory. Namely, the tone-source-access signal TGAC is used for, for example, control to deliver address signal from the tone source section 14 to the address bus 27A, and control to take waveform sample data read out onto the data bus 27D into the tone source section 14.

Figure 4:
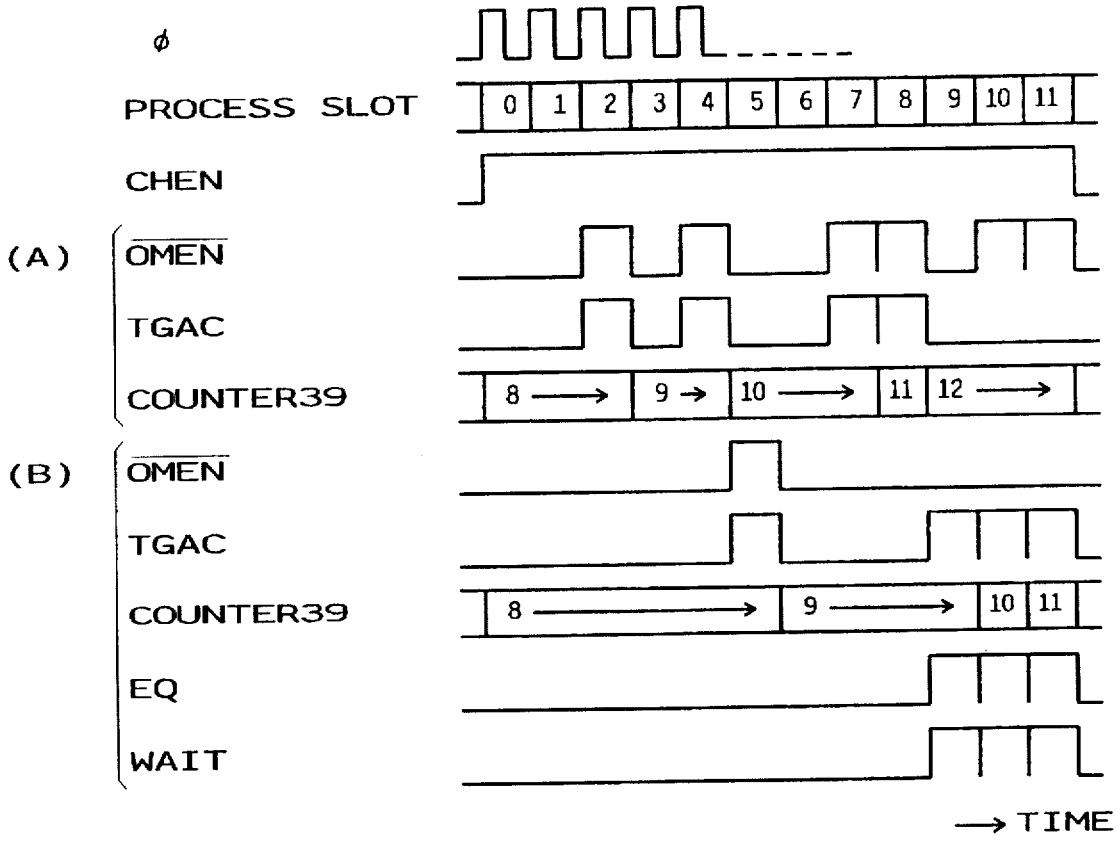
FIG. 4 is a timing chart explanatory of an example operation of the access control section in FIG. 3.

Because the number of the process slots necessary for the tone source section 14 to make one access to the external memory is four as mentioned earlier, the necessary number of the tone-source-access signal TGAC can be safely generated if at least four tone-source-utilization-enable signals $\overline{\text{OMEN}}$ are generated during the twelve process slots 0–11 of one channel slot. An example timing chart explaining such an operation is shown in item (A) of FIG. 4. According to this example, the tone-source-utilization-enable signal $\overline{\text{OMEN}}$ becomes "1" at six process slots 2, 4, 7, 8, 10 and 11. Before the count of the counter 38 coincides with that of the counter 39, the counter 39 continues to increment its count in response to generation of the tone-source-access signal TGAC and thus there occurs no output from the comparator 41. When the necessary four tone-source-access signals TGAC have been generated in correspondence to the tone-source-utilization-enable signals OMEN generated during four process slots 2, 4, 7, 8, the counter 39 shows its count of "12". In response to this, output signal of the detector 40 becomes "1" and output signal of the NOR gate becomes "0" which makes the AND gate 37 inoperative. Thus, there will not be generated any more tone-source-access signal TGAC than the necessary number of four.

In the case where less than the necessary number of the tone-source-utilization-enable signals $\overline{\text{OMEN}}$ is generated, tone-source-access signal TGAC enough to achieve the necessary number is generated in a compulsory manner on the basis of the coincidence output EQ of the comparator 41 in the following manner.

For example, in the case where no tone-source-utilization-enable signal $\overline{\text{OMEN}}$ has been generated prior to process slot 8, it is meant that no tone-source-access signal TGAC has been generated, and thus the counter 39 maintains a count of "8" until process slot 8 is reached. The counter 38 reaches a count of "8" at slot 8. In response to this, the coincidence output EQ of the comparator 41 turns into "1" and "1" is given via the OR gate 44 to the AND gate 37, so that output of the AND gate 37 turns into "1" to generate tone-source-access signal TGAC. By such generation of the tone-source-access signal TGAC, the counter 39 is incremented by one to provide a count of "9" at next process slot 9. Then, the coincidence output EQ of the comparator 41 again becomes "1", and another tone-source-access signal TGAC is generated, and so on. In this manner, the necessary four tone-source-access signals TGAC are generated at the remaining four process slots 8, 9, 10, 11.

In the case where only one tone-source-utilization-enable signals $\overline{\text{OMEN}}$ has been generated prior to process slot 9, it is meant that only one tone-source-access signal TGAC has been generated and thus the counter 39 has reached a count of "9" at process slot 9. The counter 38 reaches a count of "9" at slot 9, in response to which the coincidence output EQ of the comparator 41 turns into "1". Then, in a similar manner to the above-mentioned, tone-source-access signals TGAC are generated at the remaining three process slots 9, 10, 11 with the result that four tone-source-access signals TGAC are generated as required. An example timing chart explaining such an operation is shown in item (B) of FIG. 4. According to this example, a tone-source-utilization-enable signal $\overline{\text{OMEN}}$ is generated at process slot 5.

Similarly, in the case where only two tone-source-utilization-enable signals OMEN have been generated prior to process slot 10, the counter 39 has reached a count of "10" at process slot 10. The counter 38 reaches a count of "10" at slot 10 and thus the coincidence output EQ of the comparator 41 turns into "1". Then, in a similar manner to the above-mentioned, tone-source-access signals TGAC are generated at the remaining two process slots 10, 11. Further, in the case where three tone source utilization enable signals OMEN have been generated prior to process slot 11, the coincidence output EQ of the comparator 41 turns into "1" at the remaining one process slot 11 and thus a tone-source-access signals TGAC is generated.

When tone-source-access signals TGAC is generated on the basis of the coincidence output EQ in the above-described manner, CPU-access-request signal OMEN is being generated to provide a state in which the CPU 15 essentially can access the external memory, and therefore it is necessary to request the CPU 15 to temporarily wait. To this end, coincidence output EQ of the comparator 41, output of the NOR gate 43 and CPU-access-request signal OMEN are provided to an AND gate 45, so that, when compulsorily generating tone-source-access signals TGAC on the basis of the coincidence output EQ with CPU-access-request signal OMEN being concurrently generated, the AND gate 45 generates output signal "1" which is supplied to the CPU 15 as WAIT signal. At such a process slot where the WAIT signal is supplied, the CPU 15 temporarily interrupts its access to the external memory, and it then waits until the WAIT signal disappears.

Next, an example detailed structure of the tone source section 14 will be described with reference to several figures starting with FIG. 5.

Figure 5:
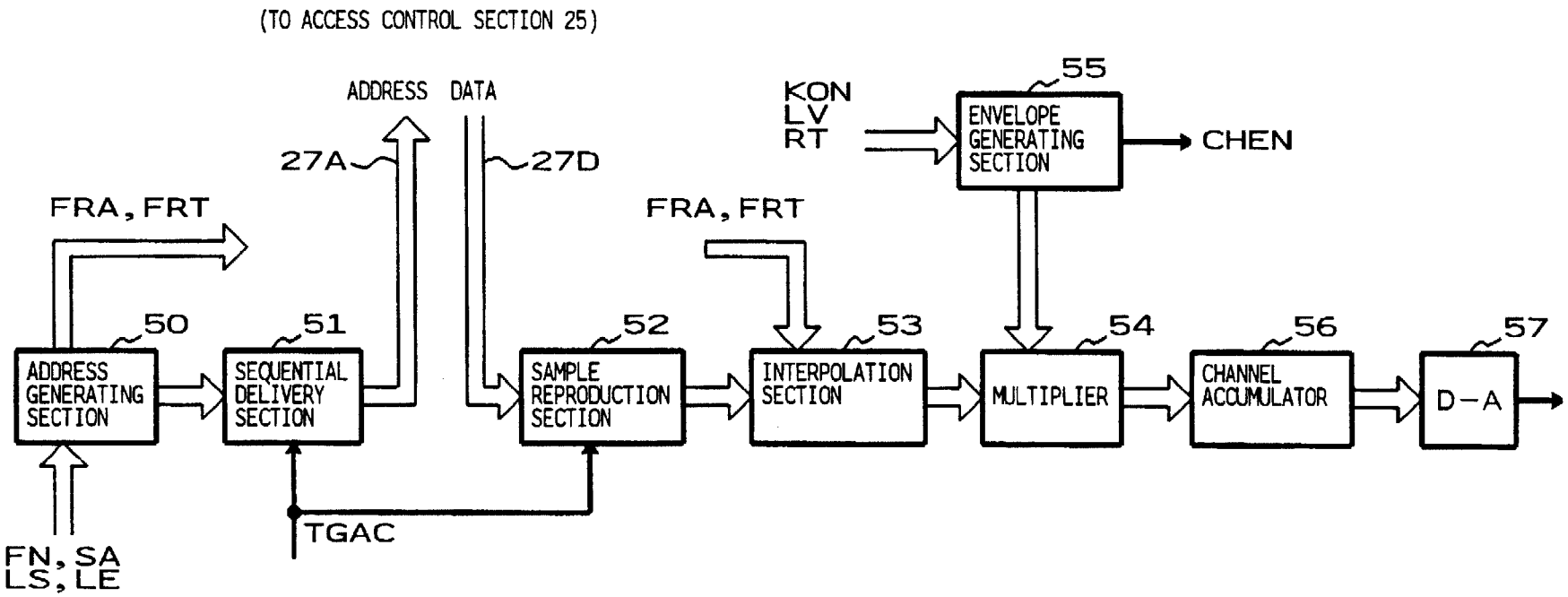
FIG. 5 is a block diagram illustrating an example detailed structure of the tone source section shown in FIG. 1.

FIG. 5 is a block diagram showing the overall structure of the tone source section 14. An address generating section 50 receives predetermined ones of various tone forming parameter data that are supplied from the CPU 15 for each of the channels. Among such predetermined data are: a frequency number FN for setting tone pitch; start address data SA designating a start address of waveform sample data to be read out from the ROM 18; loop-start address data LS designating a start address for repeated (looped) readout, and loop-end address data LE designating an end address for repeated readout. Based on the received parameter data, the address generating section 50 generates, on a time divisional basis, address signal AD for each channel which is used for reading out waveform sample data from the ROM 18. Because, as mentioned earlier, each waveform sample data is constructed of twelve bits and stored across two addresses in the ROM 18, the address generating section 50 generates two address signals AD to read out one waveform sample data. Further, because two waveform sample data are read out from the ROM 18 and then interpolated into one sample of tone signal data, the address generating section 50 generates a total of four address signals AD in one channel slot. The address signal AD for reading out the waveform sample data from the ROM 18 corresponds to the integer part of the generated address signal, and address for interpolation operation corresponds to decimal fraction part data FRA (or FRT) of the address signal.

The start address data SA is absolute address data, and both the loop-start address data LS and the loop-end address data LE are relative address data to the start address data SA. More specifically, each of the loop-start and loop-end address data LS, LE do not directly correspond to the relative memory addresses of the ROM 18 each of which is constructed of eight bits, but it corresponds to a sample number (namely, sample address).

A sequential forwarding or delivery section 51, in response to the tone-source-access- signal TGAC generated in the access control section 25, sequentially delivers to the address bus 27A four address signals AD generated in the address generating section 50. As previously mentioned, the address signals delivered to the address bus 27A are given via the access control section 25 to the address bus 17A of the ROM 18. In response to the address signals thus given, waveform data are read out from the ROM 18 and sent via the data bus 27D to a sample data reproduction section 52. The sample data reproduction section 52 inputs the waveform data on the data bus 27 in response to the tone-source-access-signal TGAC, and it synthesizes readout data for two addresses so as to reproduce one sample of waveform sample data which is constructed of twelve bits.

Two samples of waveform sample data thus reproduced by the sample data reproduction section 52 are input to an interpolation section 53, where the two samples are interpolated in accordance with the decimal fraction part data FRA (or FRT) provided from the address generating section 50. One sample of waveform sample data resultant from the interpolation operation is applied to a multiplier 54, where the sample is multiplied by envelope signal provided from an envelope generating section 55. Thereafter, waveform sample data of each of the channels are accumulated by a channel accumulator 56, and the accumulated value is converted by a digital-to-analog converter 57 into an analog signal. The envelope generating section 55 receives predetermined ones of various tone forming parameter data given from the CPU 15 for each of the channels. Among data received by this section 55 are: key-on data instructing a start of tone generation; level data LV instructing target levels at various envelope segments such as attack, decay, sustain and release, and rate data RT instructing inclinations of the envelope segments. On the basis of the received parameter data, the envelope generating section 55 generates envelope signal for each channel on a time divisional basis. Further, on the basis of current levels of the key-on data KON and envelope signal, the envelope generating section 55 generates channel-enable signal CHEN, i.e., tone-source-utilization-request signal for each of the channels. For example, as for such a channel where any tone has been assigned but generation of the assigned tone has not yet been completed, the envelope generating section 55 generates channel-enable signal CHEN, i.e., tone-source-utilization-request signal in the associated channel slot. This is because it is required to actually generate a tone in that channel and hence to read waveform data from the ROM 18. Conversely, as for such a channel where no tone is assigned or such a channel where generation of the assigned tone has already been completed, it is not required to read waveform data from the ROM 18 and hence no channel-enable signal CHEN, i.e., tone-source-utilization-request signal is generated. Operations of the various circuits in the tone source section 14 are time-divisionally performed for the individual channels in synchronism with the time divisional channel slots as shown in FIG. 2, and therefore the tone forming parameter data are time-divisionally supplied to the individual channels in synchronism with the channel slots.

Figure 6:
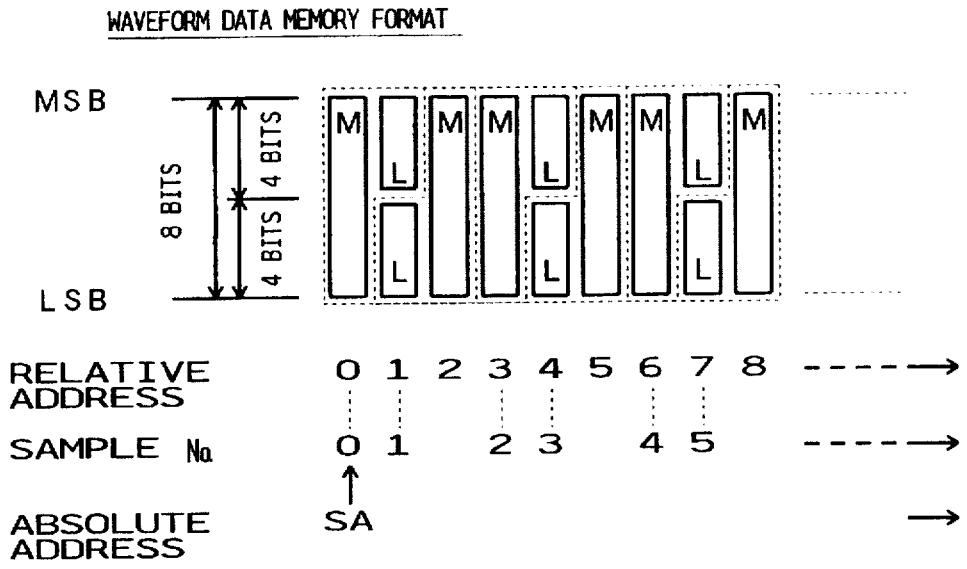
FIG. 6 is a diagram illustrating an example memory format of waveform data in the external memory ROM shown in FIG. 1.

Next, an example memory format of waveform data in the ROM 18 will be described with reference to FIG. 6. As shown, each address of the ROM 18 comprises one byte= eight bits, and each sample data comprising twelve bits is divided into upper eight-bit data and lower four-bit data which are stored across adjacent two addresses. The upper eight-bit data of sample number "0" data is stored at relative address "0" (namely, start address SA in absolute address), and the lower four-bit data of sample number "0" data is stored at the upper four bits of the next relative address "1". The lower four-bit data of sample number "1" is stored at the lower four bits of relative address "1", and the upper-eight-bit data of data of sample number "1" is stored at the still next relative address "2". Data of other sample numbers are sequentially stored in a similar format in the order of the sample numbers. In FIG. 6, "M" indicates the location of the most significant bit of each waveform sample data, while "L" indicates the location of the least significant bit. It may be apparent from FIG. 6 that, as for each even number sample data including sample number "0" data, the address storing the upper eight-bit data precedes the address storing the lower four-bit data; conversely, as for each odd number sample data, the address storing the lower four-bit data precedes the address storing the upper eight-bit data.

Next, an example detailed structure of the address generating section 50 will be described with reference to FIG. 7.

An adder 60 and a 16-stage shift register 61 together construct an accumulator which time-divisionally accumulates the frequency number FN of each of the channels (sixteen channels) to generates progressive-phase signal of a pitch corresponding to the frequency number FN. Shift clock pulse signal $\phi$ 12 applied to the shift register 61 has a period twelve times the period of the clock pulse signal $\phi$ so that the shift register 61 makes a shift action for each channel slot. A selector SEL1 is made inoperative at the start of tone generation by note-on pulse NONP so as to clear the accumulated frequency number of the channel concerned. Normally, the selector SEL1 selects output data of the shift register 61 applied to its A input and gives the selected data to the adder 60. Frequency number FN is provided to the adder 60, where it is added to the last accumulated value. In this way, accumulation of frequency number FN is repeated. As more fully described later, the selector SEL1 selects B input when an overflow signal OV is given from a latch LA4.

The accumulated value of frequency number FN indicates a sample address of waveform sample data to be generated during a current sample time and it has an integer part INT and a decimal fraction part FRA. The integer part INT indicates a sample number (see FIG. 6) of waveform sample data to Be read out from the external memory.

On the basis of the output of the frequency number accumulator, i.e., data of the integer part INT of sample address signal provided from the shift register 61, the address generating section 50 generates four address signals (memory address signals) AD for reading out the above-mentioned adjacent two sample data. To this end, selectors SEL2 to SEL4 and latches LA1 to LA5 provided in this address generating section 50 are caused to operate in a predetermined sequence. Although not shown for convenience, various control signals are provided from a control circuit 62 to these selectors SEL2 to SEL4 and latches LA1 to LA5.

Figure 8:
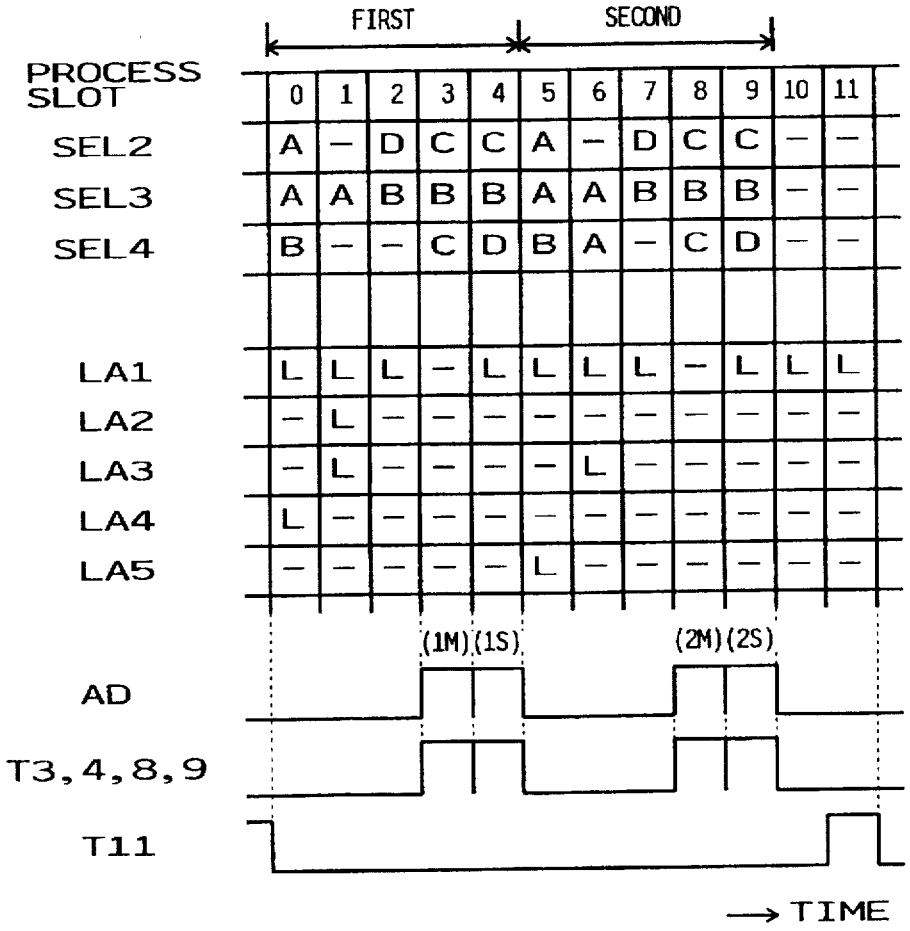
FIG. 8 is a timing chart explanatory of an example operation of the address generating section shown in FIG. 7.

A manner in which the control circuit 62 controls the selectors SEL2 to SEL4 and latches LA1 to LA5 is generally illustrated in FIG. 8. In more specific terms, FIG. 8 illustrates how control is made of the address signal generation operations in the address generating section 50. The address generating section 50 has an operation cycle corresponding to the twelve process slots 0–11. At process slots 0 to 4, the generating section 50 carries out a process for generating two address signals (denoted by AD(1M) and AD(1S)) to read out first waveform sample data. At process slots 5 to 9, the generating section 50 carries out a process for generating two address signals (denoted by AD(2M) and AD(2S)) to read out second waveform sample data. The generating section 50 operates slightly differently depending upon whether or not the overflow signal OV has been given from the latch LA4; however, FIG. 8 only illustrates the operations carried out when such an overflow signal OV has not been given from the latch LA4.

In FIG. 8, characters such as "A", "B", "C" etc. provided in connection with the selectors SEL2 to SEL4 denote an input that is selected in the selectors SEL2 to SEL4 at the corresponding process slots, and a short bar "—" indicates that no input is selected. Further, character "L" provided in connection with the latches LA1 to LA5 indicates that data is taken into or latched into the corresponding latch LA1 to LA5 at the corresponding process slot.

Before describing in detail the specific operations of the address generating section 50, general description will be made on characteristic features of the repeated (looped) waveform readout operations according to this embodiment.

Technique of repeatedly reading out waveform data between loop-start address LS and loop-end address LE is well known in the art. In such a case, in order to achieve a smooth waveform link from the loop end back to the loop start, it is desirable to choose such portions where level of waveform data corresponding to the loop-start address LS is substantially equivalent to level of waveform data corresponding to the loop-start address LS and yet waveform inclinations are similar. However, if such choice is made as desired, the loop-start and/or loop-end position may not necessarily fall at a break point between sample sections. Thus, in the past, there was no other alternative but to compulsorily place the loop-start and loop-end positions at a break between sample sections, and hence it was not possible to achieve an ideal smooth waveform link from the loop end back to the loop start.

Figure 9:
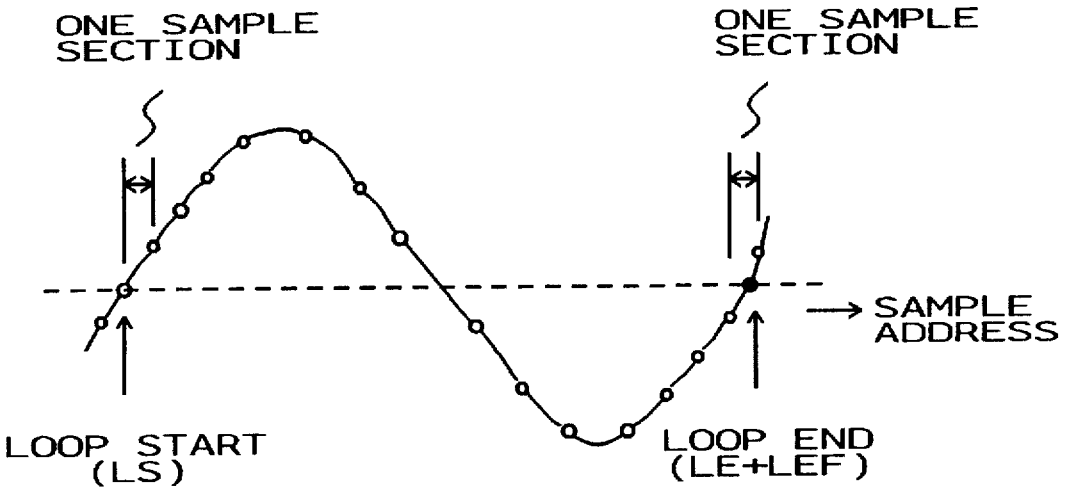
FIG. 9 is a diagram explanatory of a loop start position and a loop end position established for repeatedly reading out a waveform.

As opposed to the conventionally-known technique, this embodiment of the present invention employs an improved repeated readout approach as illustrated in FIG. 9. That is, for example, the loop-start position is determined to fall at a break point between sample sections, while the loop-end position LE is determined to fall at any suitable point other than a break point which allows an ideal smooth waveform link. Therefore, the loop-end address LE is not situated at a break point between sample sections and contains a decimal fraction part. In this example, interpolation is performed in accordance with this decimal fraction part of the loop-end address LE at least when the current waveform sample reaches or arrives at the integer part of the loop end, so that the link from the loop end to the loop start is made when the current waveform sample reaches, as accurately as possible, the loop-end position including the decimal fraction part. In view of the above-mentioned objects of the invention, it will be readily appreciated that, although this illustrated embodiment is shown as always performing waveform interpolation, it suffices to at least perform interpolation corresponding to the decimal fraction part of the loop-end address. As will also be appreciated that, contrary to the illustrated embodiment, the loop-end address may comprise the integer part alone and decimal fraction part may be contained into the loop-start address. Moreover, although the loop is shown in FIG. 9 as being made for only one cycle of a waveform, the loop may be made for more cycles.

To this end, decimal fraction part data LEF of the loop-end address is established to provide a precise loop-end position, while the loop-end address data LE is established in integer; that is, the loop-end address is made up of a value including not only an integer part but a decimal fraction part. In the example of FIG. 7, decimal fraction part data LEF of the loop-end address is applied to an adder 64 in which it is added with decimal fraction part data FRA of the current address (current sample number). In this example, the decimal fraction part data LEF of the loop-end address is expressed in 2s complement, and virtually the adder 64 performs a subtraction of FRA—LEF by addition of the 2s complement. When FRA≧LEF, the adder 64 generates carry-out signal which is given, as decimal fraction part carry-out signal FC, to B input of the selector SEL4. Further, as more fully described later, the output of the adder 64, i.e., difference obtained from FRA—LEF is utilized as decimal fraction part data FRT Next, operations at the individual process slots will be described with reference to FIGS. 7 and 8.

—process slot 0—

At this process slot 0, it is determined whether or not the current sample address (current sample number) containing the decimal fraction part FRA has arrived at to the loop-end address LE containing the decimal fraction part LEF. Namely, A input is selected in the selector SEL3 so that the integer part INT indicative of the current sample address (current sample number) is input to an adder 63. Also, A input is selected in the selector SEL 2 so that the loop-end address data LE of the integer part is input to the adder 63. Moreover, B input is selected by the selector SEL4 so that the decimal fraction part carry-out signal FC is input to the adder 63.

The loop-end address decimal fraction part data LE is expressed in 1s complement, and so virtually the adder 63 performs a subtraction of INT—LE by addition of the 1s complement. Therefore, in the case where INT=LE is met, when "1" is given as the decimal fraction part carry-out signal FC from the adder 64, the adder 63 outputs carry-out signal which is input to the latch LA4. At this process slot 0, the latch LA4 is given a load command and latches the carry-out signal from the adder 63. Output of the latch LA4 is given, as the overflow signal OV, to the selector SEL1, control circuit 62 and other circuits. Stated in another way, the overflow signal OV becomes "1" when a carry-out signal has been generated from the adder 63, i.e., when the current address (current sample number) containing the decimal fraction part FRA has arrived at or exceeded the loop-end address LE containing the decimal fraction part LEF. In other words, the overflow signal OV becomes "1" when INT=LE has been established for the integer parts and FRA≧LEF has been established for the decimal fraction parts. However, in FIG. 8, there are shown example operations in the case where the overflow signal OV is "0", i.e., where the current address (current sample number) has not yet arrived at the loop-end address LE. When given a load command, the latch LA1 latches the output signal of the adder 63.

—process slot 1—

At process slot 1, A input is selected in the selector SEL3 so that the integer part INT indicative of the current address (current sample number) is input to the adder 63. A load signal is applied to the latches LA1, LA2, LA3 so that the integer part INT output from the adder 63 is latched into the latches LA1, LA2, LA3. At this time, the latch LA3 only latches the least significant bit LSB which is then utilized as data E/O indicative of whether the sample number is an even number or an odd number.

—process slot 2—

At process slot 2, the value of the integer part INT of the sample address signal indicative of the current sample number is multiplied by 1.5 so as to form address data that indicates an actual relative address in the ROM 18 (memory address). At this slot, the integer part data INT latched into the latch LA1 at the preceding slot 1, i.e., the current sample number data is applied to a ½ shift circuit 65, so that the data as ½ shifted (0.5 times) is output from the ½ shift circuit 65. It is assumed that decimal fraction part of the INT/2 is discarded.

Further, at this slot 2, B input is selected in the selector SEL3 so that the integer part data INT latched into the latch LA1 at the preceding slot 1, i.e., the current sample number data is applied to the adder 63, and D input is selected in the selector SEL2 so that the above-mentioned value INT/2 output from the ½ shift circuit 65 is applied to the adder 63. Consequently, the adder 63 outputs a value INT+INT/2 which has been obtained by multiplying the sample number indicating integer part INT by 1.5 and then discarding the decimal fraction part therefrom. Thereafter, a load signal is given to the latch LA1 so that the output INT+INT/2 of the adder 63 is latched into the latch LA1.

As may be understood from FIG. 6, because the twelve-bit sample data is stored at one and half addresses, a sample address corresponding to a sample number as multiplied by 1.5 becomes a memory address indicative of an actual relative address. And, a value INT+INT/2 which has been obtained by multiplying the sample number indicating integer portion INT by 1.5 and then discarding the decimal fraction part therefrom indicates the first memory address of two addresses storing one sample data corresponding to an integer part INT.

—process slot 3—

At slot 3, start address data SA is added to the relative memory address data INT stored into the latch LA1 so that the latter data INT is converted into absolute address data, on the basis of which there is created an address signal AD(1M) indicating an address storing the upper eight-bit data of the first sample data corresponding to the current sample number. Stated in another way, B input is selected in the selector SEL3 so that the relative memory address data INT+INT/2 stored into the latch LA1 is applied to the adder 63, and C input is selected in the selector SEL2 so that start address data SA is applied to the adder 63. Further, C input is selected in the selector SEL4 so that the even number/odd number data E/O stored into the latch LA3 at the above-mentioned slot 1 is applied to the adder 63.

As may be understood from FIG. 6, if the sample number is an even number, the upper eight bits of one sample data are stored at the former address of adjacent two memory addresses and the lower four bits are stored at the latter address. Further, if the sample number is an even number, the data E/O is "0", and output of the Adder 63 becomes SA+INT+INT/2 indicating the preceding address storing the upper eight-bit sample data.

Conversely, if the sample number is an odd number, the upper eight bits of one sample data are stored at the latter address of adjacent two memory addresses and the lower four bits are stored at the former address. Further, if the sample number is an odd number, the data E/O is "1", and output of the adder 63 becomes SA+INT+1+INT/2 indicating the following address storing upper eight-bit sample data.

In this way, at this slot 3, a memory address data AD(IM) indicative of an address storing the upper eight-bit data of the first sample data corresponding to the current sample number is created and output from the adder 63.

—process slot 4—

At slot 4, there is created an address signal AD(1S) indicative of an memory address at which the lower four-bit data of the above-mentioned first sample data. Namely, as at the above-mentioned slot 3, B input is selected in the selector SEL3 and C input is selected in the selector SEL2 so that start address data SA is added to relative address data INT+INT/2 in the adder 63. On the other hand, D input is selected in the selector SEL4 so that a signal obtained by inverting the output data E/O of the latch LA3 through an inverter 66 is applied to the adder 63. Therefor, in a manner contrary to process slot 3, if the current sample number is an even number, output of the adder 63 becomes SA+INT+1+INT/2 which indicates the following address storing lower four-bit sample data, and, if the sample number is an odd number, output of the adder 63 becomes SA+INT+INT/2 which indicates the preceding address storing lower four-bit sample data.

In this way, at this slot 4, a memory address data AD(1S) indicative of an address storing the lower four-bit data of the first sample data corresponding to the current sample number is created and output from the adder 63.

—process slots 5 to 9—

At process slots 5–9, there are performed controls similar to those at the above-described process slots 0–4, so that, for the second sample data corresponding to the sample number next to the current sample number, an address signal AD(2M) at which upper eight-bit data is stored, as well as an address signal AD(2S) at which lower four-bit data is stored.

Differences of these process slots 5–9 from the process slots 0–4 are as follows. At process slot 6 corresponding to process slot 1, A input is selected in the selector SEL3 so that the integer part data INT indicating the current sample number is applied from the latch LA1 to the adder 63, and also A input is selected in the selector SEL4 so that signal "1" is applied to the adder 63. This causes data INT+1 indicative of the sample number next to the current number INT to be output from the adder 63. The data output from the adder 63 is then latched into the latch LA1.

At the following process slots 7–9, processes similar to those at the above-described process slots 2–4 are performed, with the sample number INT being replaced with INT+1. As the result, at process slot 8, an address signal AD(2M) that is indicative of an address storing the upper eight-bit data of the second sample data corresponding to the sample number next to the current sample number is created and output from the adder 63. Further, at process slot 9, an address signal AD(2S) that is indicative of an address storing the lower four-bit data of the second sample data is created and output from the adder 63.

By the way, at process slot 5, a load signal is given to the latch LA5 so that the even number/odd number data E/O of the sample number related to the first sample data latched into the latch LA3 at process slot 1 is latched into the latch LA5. Thereafter, a load signal is given to the latch LA6 at process slot 6 so that the even number/odd number data E/O of the sample number INT+1 related to the second sample data is latched into the latch LA3. Thus, even number/odd number data E/O of sample numbers of two sample data latched into the latches LA5, LA3 are taken into a delay circuit 67 at suitable timings, through which the data are delayed by a suitable time (in this embodiment, time corresponding to about 1.5 channel slots) for timing adjustment purposes and are output as control signals CONT1 and CONT2, respectively. The control signals CONT1, CONT2 are used in the sample reproduction section 52 for accurately retrieving lower four-bit data of sample data out of read out one address (eight bits) data.

<Process performed upon arrival at loop end>

Next, description will be made on a process when the current sample address has arrived at the loop-end address in terms of the integer and decimal fraction part.

As mentioned previously, it is determined at process slot 0 whether the current sample address has arrived at the loop-end address in terms of the integer and decimal fraction part. This is because coincidence of the integer part INT of the current sample address with the loop-end address LE alone does not cause a carry-out signal to be generated from the adder 63. When the condition of INT=LE has been met with respect to the integer parts and at the same time the condition of FRA≧LEF has been met with respect to the decimal fraction parts (i.e., when the decimal fraction part FRA of the current sample address has arrived at or exceeded the decimal fraction part of the loop-end address), there generated from the adder 64 a carry-out signal corresponding to the establishment of FRA≧LEF, in response to which the adder 63 generates a carry-out signal "1" which is latched into the latch LA4. Then, output of the latch LA4 is given as the overflow signal OV to the selector SEL1, control circuit 62 and other circuits. When the carry-out signal has been generated from the adder 63, i.e., the current sample address has arrived at the loop-end address with respect to the integer and decimal fraction parts, the overflow signal becomes "1". The control circuit 62, when it confirms that the overflow signal OV has become "1", alters the controls at process slots 1 and 6 as follows.

Namely, at process slot 1, B input is selected in the selector SEL3 so that the output of the adder 63 latched into the latch LA1 at the preceding process slot 0, i.e., the difference between the integer part INT of the current sample address and the loop-end address LE (strictly speaking, value to which "1" of the carry-out signal FC has been added) is applied to the adder 63. At the same time, B input is selected in the selector SEL2 so that loop-start address data LS is applied to the adder 63. Further, a load signal is given to the latches LA1, LA2, LA3 so that output INT−LE+LS of the adder 63 is latched into these latches LA1, LA2, LA3. As may be apparent from the foregoing, when the current sample address has arrived at the loop-end address with respect to the integer and decimal fraction parts, output of the adder 63 is INT−LE=0, and the value latched into the latch LA1 is substantially coincident with the value of the loop-start address. It should be appreciated that, if the frequency number FN is a large number greater than 1, output INT−LE of the adder 63 at the time of arrival at the end address may be grater than 1.

The above-mentioned various processes at the subsequent process slots 2–4 using the output of the latch LA1 as current sample address data will all be performed with respect to a value INT−LE+LE (substantially equals LS).

Similar alteration is made at process slot 6. Namely, B input is selected in the selector SEL3 and at the same time B input is selected in the selector SEL2 so that values of INT−LE and LS are added together in the adder 63. Of course, at this process slot 6, signal "1" selected at A input of the selector SEL4 is, as described previously, further applied to the adder 63, so that the adder 63 outputs a value indicative a sample address INT−LE+LS+1 (which substantially equals LS+1) next to the value INT−LE+LS corresponding to the loop-start address LS.

The value INT−LE+LS (which substantially equals LS+1) corresponding to the loop-start address LS latched at process slot 1 into the latch LA2 is a value consisting of an integer part. The value INT−LE+LS is added with the decimal fraction part data FRT output from the adder 64 and is then applied to B input of the selector SEL1.

As previously mentioned, the loop-end address is established as a value containing a decimal fraction part. The adder 64 obtains the difference FRA−LEF between the loop-end address decimal fraction part data LEF expressed in 2s complement and the current sample address decimal fraction part FRA, and the obtained difference FRA−LEF is output as decimal fraction part data FRT for the loop-end arrival time. This decimal fraction part data FRT represents a deviation of the decimal fraction parts for a time when the current sample address has arrived at the loop-end address. When the decimal fraction parts are coincident with each other, FRA−LEF=FRT=0. In many cases, when FRA has become slightly greater than LEF, the condition FRA≧LEF is established so that the decimal fraction part deviation data FRA−LEF=FRT may indicate a small positive decimal fraction value.

Upon arrival at the loop-end, the sample address, as previously mentioned, is returned to the value INT−LE+LS (which substantially equals LS+1) corresponding to the loop-start address LS, and sample data corresponding to the loop-start address LS is read out from the ROM 18. No problem arises when the integer part FRA of the sample address is coincident with the loop-end address integer part LEF. But, when the integer parts FRA and LEF are coincident with each other, it is necessary to compensate the value of sample data read out from the ROM 18, in accordance with the decimal integer part deviation FRT. To this end, the decimal fraction part data FRT=FRA−LEF corresponding to the deviation is supplied to the interpolation section 53, in which the sample data corresponding to the loop-start address LS read out from the ROM 18 is interpolated in accordance with this decimal fraction part data FRT.

When returning from the loop-end address to the loop-start address, it is also necessary to return the value of the above-mentioned frequency number accumulator to a value corresponding to the loop-start address. To this end, when the overflow signal OV has become "1", B input is selected in the selector SEL1 so that the value INT−LE+LS (which substantially equals LS) corresponding to the loop-start address latched into the latch LA2 is applied to the adder 60. Since, at this time, it is necessary to take the decimal fraction part deviation FRT into consideration, output of the latch LA2 (virtually LE) is made an integer part to which the decimal fraction part data FRT is added, to prepare a loop-start address containing integer and decimal fraction parts. The thus-prepared loop-start address is applied to B input of the selector SEL1.

Next, an example detailed structure of the sequential delivery section 51 will be described with reference to FIG. 10.

Figure 7:
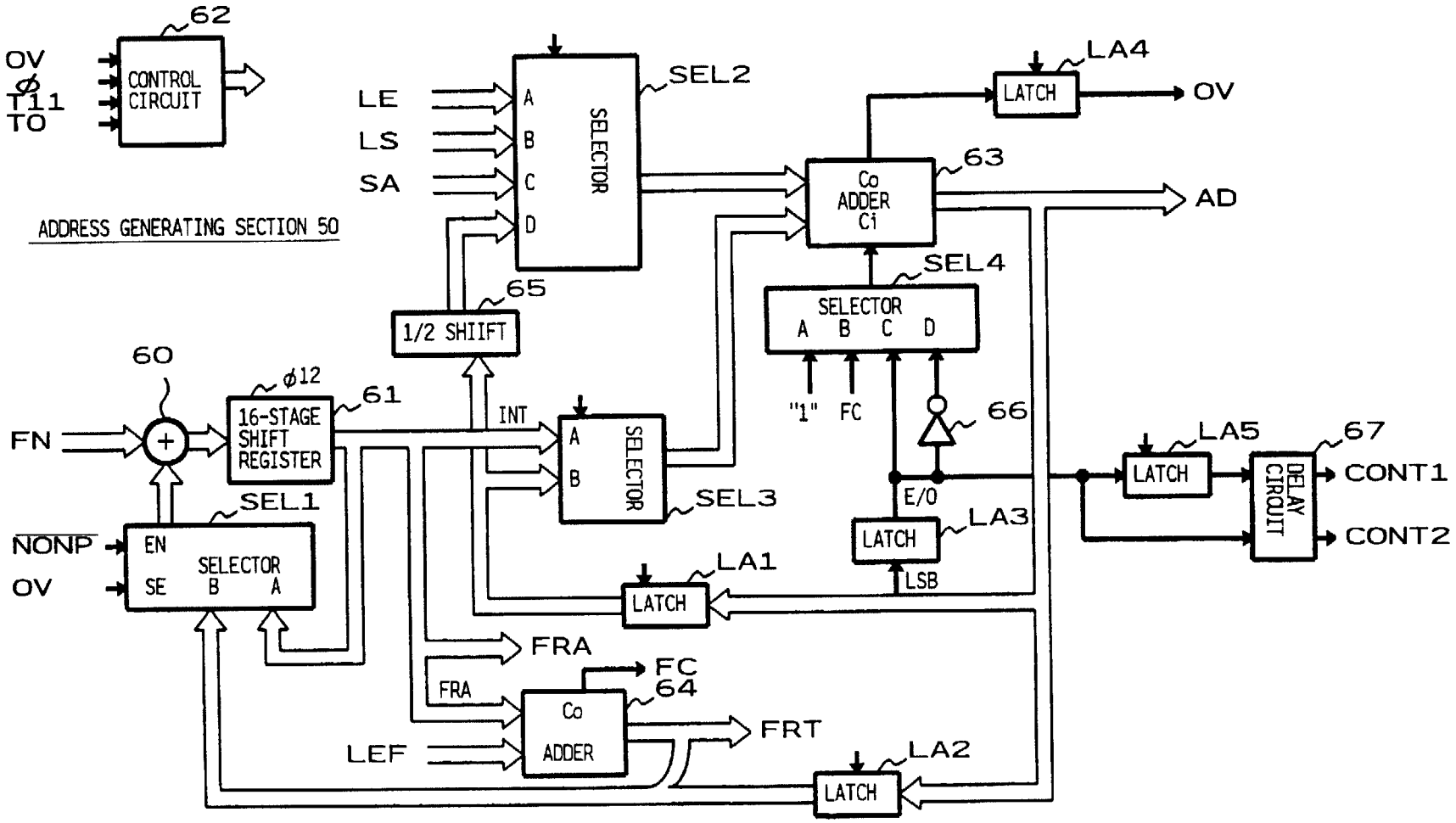
FIG. 7 is a block diagram illustrating an example detailed structure of the address generating section shown in FIG. 1.
Figure 10:
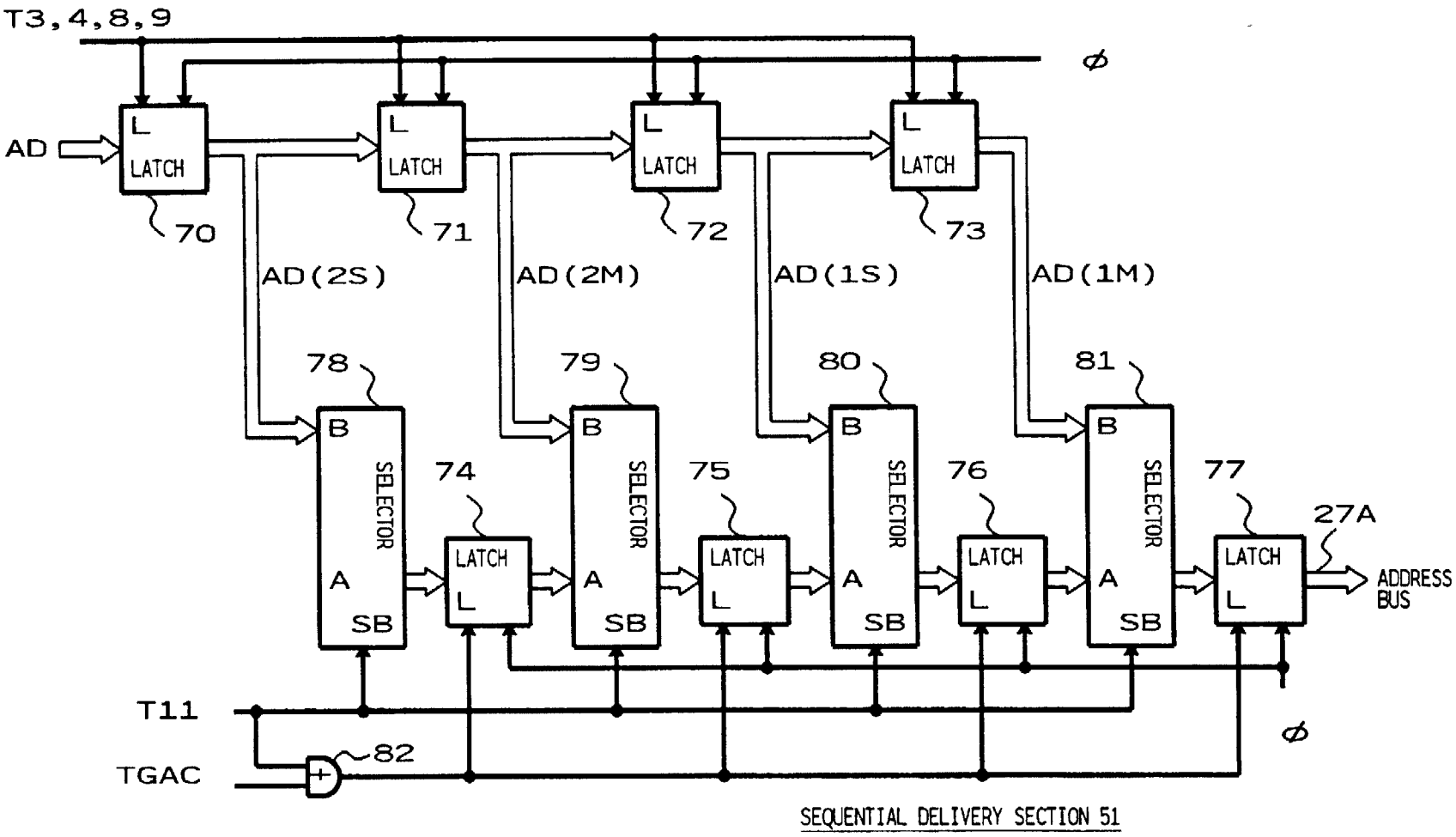
FIG. 10 is a block diagram illustrating an example detailed structure of the sequential delivery section shown in FIG. 5.

In FIG. 10, the memory address signal AD output from the adder 63 of FIG. 7 is input to the first latch 70 of four latches 70, 71, 72, 73 connected in series with each other. To load control input L of each of the four latches 70, 71, 72, 73 is given timing signal T3, 4, 8, 9 which becomes "1" at process slots 3, 4, 8, 9. As shown in FIG. 6, generation timing of this timing signal T3, 4, 8, 9 corresponds to generation timing of the above-mentioned four address signals AD(IM), AD(1S), AD(2M), AD(2S). Further, the clock pulse signal $\phi$ is input to each of the latches 70, 71, 72, 73 as output control signal so that the latches 70, 71, 72, 73 output their latched data at the next slot.

With such arrangements, when the four address signals AD(IM), AD(1S), AD(2M), AD(2S) are sequentially output as the memory address signal AD at these process slots 3, 4, 8, 9, these signals are sequentially latched into the latches 70, 71, 72, 73. Therefore, at the last process slot of one channel slot, the above-mentioned four address signals AD(IM), AD(1S), AD(2M), AD(2S) have been respectively latched into the latches 71, 72, 73, 70.

Outputs of the latches 70, 71, 72, 73 are input, via B inputs of selectors 78, 79, 80, 81, to latches 74, 75, 76, 77, respectively. The above-mentioned tone-source-access signal TGAC generated from the AND gate 37 of FIG. 3 is given via an OR gate 82 to load control inputs L of the latches 74, 75, 76, 77. Further, the timing signal T11 is given via the OR gate 82 to the load control inputs L of the latches 74, 75, 76, 77. The timing signal T11 is also given to B control inputs SB of the selectors 78, 79, 80, 81 so that they select their B inputs only at process slot 1 and select their A input at the other process slots. Moreover, the latches 74, 75, 76, 77 are connected in series with each other via the A inputs of the selectors 78, 79, 80, 81 and are each given the clock pulse signal $\phi$, so that these latches 74, 75, 76, 77 output their latched data at the next process slot.

With such arrangements, at process slot 11, the above-mentioned four address signals AD(IM), AD(1S), AD(2M), AD(2S) are given, via the B inputs of the selectors 78 to 81, from the latches 71, 72, 73, 70 to the latches 77, 76, 75, 74, respectively. Then, each time the tone-source-access signal TGAC is generated, output signals of the latches 74, 75, 76 are latched into the next-stage latches 75, 76, 77 via the A inputs of the selectors 79 to 81. In this manner, the above-mentioned four address signals AD(IM), AD(1S), AD(2M), AD(2S) are sequentially shifted and output from the latch 77. Output of the latch 77 is coupled to the address bus 27A of the tone source section 14.

Because of this, the address signal AD(1M) is first output to the address bus 27A and then is given to the address bus 17A of the external memory at such a process slot when the tone-source-access signal TGAC is generated for the first time. Then, at the next process slot, the next address signal AD(1S) is output from the latch 77 to the address bus 17A. Therefore, at such a process slot when the second tone-source-access signal TGAC is generated, the address signal AD(1S) is delivered through the address bus 27A to the address bus 17A of the external memory. In this way, in response to generation of each tone-source-access signal TGAC, the address signals AD(1M), AD(1S), AD(2M), AD(2S) are given to the address bus 17A in the mentioned order.

It is assumed that channel of the address signals latched into the latches 77, 76, 75, 74 is identical with that of the tone-source-access signal TGAC, i.e., that channel timing in the access control section 25 is identical with that in the sequential delivery section 51. On the other hand, channel timing in the latches 77, 76, 75, 74 is delayed exactly by one channel slot behind channel timing in the address generating section 50. Such a delay in channel timing due to delay in the circuitry operations is also caused in the next sample reproduction section 52 and further next processing circuits. In the envelope generating section 55 as well, envelope signals of the respective channel are generated in harmony with the channel timing in the multiplier 54. Ordinarily, there is a considerable amount of discrepancy between the channel timing of envelope signal to be given to the multiplier 54 and the channel timing in the sequential delivery section 51, i.e., in the access control section 25. Therefore, it is a matter of course that, in consideration of such a channel timing discrepancy, suitable timing adjustment is made such that channel timing of the utilization-request signal, namely, channel-enable signal CHEN conforms to that in the access control section 25.

Figure 11:
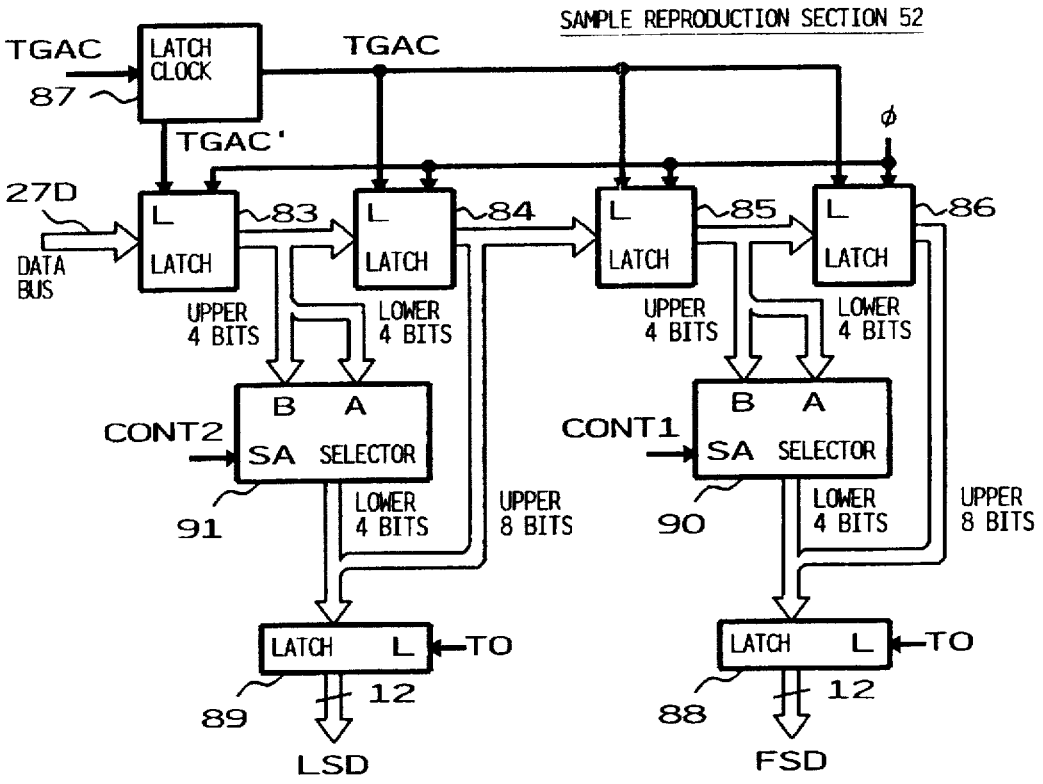
FIG. 11 is a block diagram illustrating an example detailed structure of the sample reproduction section shown in FIG. 5.

Next, description will be made on an example detailed structure of the sample reproduction 52, with reference to FIG. 11.

When the address signals AD(1M), AD(1S), AD(2M), AD(2S) have been given to the external memory (ROM 18) in response to generation of the tone-source-access signal TGAC, eight-bit data is read out from the external memory in accordance with this memory address and then forwarded to the data bus 27D of the tone source section 14. In FIG. 11, the read-out eight-bit data is latched into a latch 83.

Latches 83, 84, 85, 86 are connected in series with each other and latches their respective input data in response to latch clock signals TGAC' and TGAC generated from a latch clock signal generating circuit 87. Further, in a manner similar to the above-mentioned, clock pulse signal $\phi$ is given, as output control signal, to each of the latches 83, 84, 85, 86 in such a manner that they output the latched data at the following process slots. The latch clock signal generating circuit 87 provides the second-stage to fourth-stage latches 84 to 86 with the latch clock signal TGAC that is synchronous with the tone-source-access signal TGAC, and it provides the first-stage latch 83 with the latch clock signal TGAC' that is slightly delayed behind the tone-source-access signal TGAC. This is to allow for a time delay caused in reading out data from the memory.

When eight-bit data corresponding to the address signals AD(1M), AD(1S), AD(2M), AD(2S) have been read out in response to generation of the tone-source-access signal TGAC, the following data have been latched into the latches 83–86, respectively: into the latch 86, the upper eight-bit data of the first sample data corresponding to the address signal AD(1M); into the latch 85, the lower four-bit data of the first sample data corresponding to the address signal AD(1S); into the latch 84, the upper eight-bit data of the second sample data corresponding to the address signal AD(2M); and into the latch 83, the lower four-bit data of the second sample data corresponding to the address signal AD(2S).

Twelve-bit latch 88, which is provided for reproducing the twelve-bit first sample data as twelve-bit parallel data, inputs the output of the latch 86 at its upper eight bit inputs and inputs the output of the selector 90 at its lower four bit inputs. The twelve-bit latch 88 latches the input data at process slot 0 in response to timing signal 0. At this process slot 0, the above-mentioned four eight-bit data read out from the external memory in a channel slot immediately before the slot 0 have been latched in the latches 83 to 86, respectively.

Selector 90 inputs the lower four-bit data output of the latch 85 at its A input and inputs the upper four-bit data output at its B input. The selector also inputs, as selection control signal, the control signal CONT1 provided from the delay circuit 67 shown in FIG. 7. As previously mentioned, this control signal CONT1 corresponds to the even number/odd number data E/O related to the first sample data latched into the latch LA5 of FIG. 7. If the sample number is an even number, the control signal CONT1 is "0", so that the selector 90 selects the the upper four-bit data at its B input. Because the lower four-bit data of an even sample number is stored at the upper four bits of a memory address as shown in FIG. 6, the lower four-bit sample data can be retrieved via the B input of the selector 90. Conversely, If the sample number is an odd number, the control signal CONT1 is "1", so that the selector 90 selects the the lower four-bit data output at its A input. Because the lower four-bit data of an odd sample number is stored at the lower four bits of a memory address as shown in FIG. 6, the lower four-bit sample data can be retrieved via the A input of the selector 90.

Consequently, by latching the input data into the latch 88 at process slot 0, the twelve-bit first sample data can be taken into the latch 88 in a parallel fashion.

Likewise, twelve-bit latch 89 inputs the output of the latch 84 at its upper eight bit inputs and inputs the output of the selector 91 at its lower four bit inputs. The twelve-bit latch 89 latches the input data at process slot 0 in response to timing signal 0. The selector 90 inputs the lower four-bit data output of the latch 85 at its A input and inputs the upper four-bit data output at its B input. The selector also inputs, as selection control signal, the control signal CONT2 provided from the delay circuit 67 shown in FIG. 7. As previously mentioned, this control signal CONT2 corresponds to the even number/odd number data E/O related to the second sample data. Therefore, by latching the input data into the latch 89 at process slot 0 in a similar manner to the above-mentioned, the twelve-bit second sample data can be taken into the latch 89 in a parallel fashion.

Figure 12:
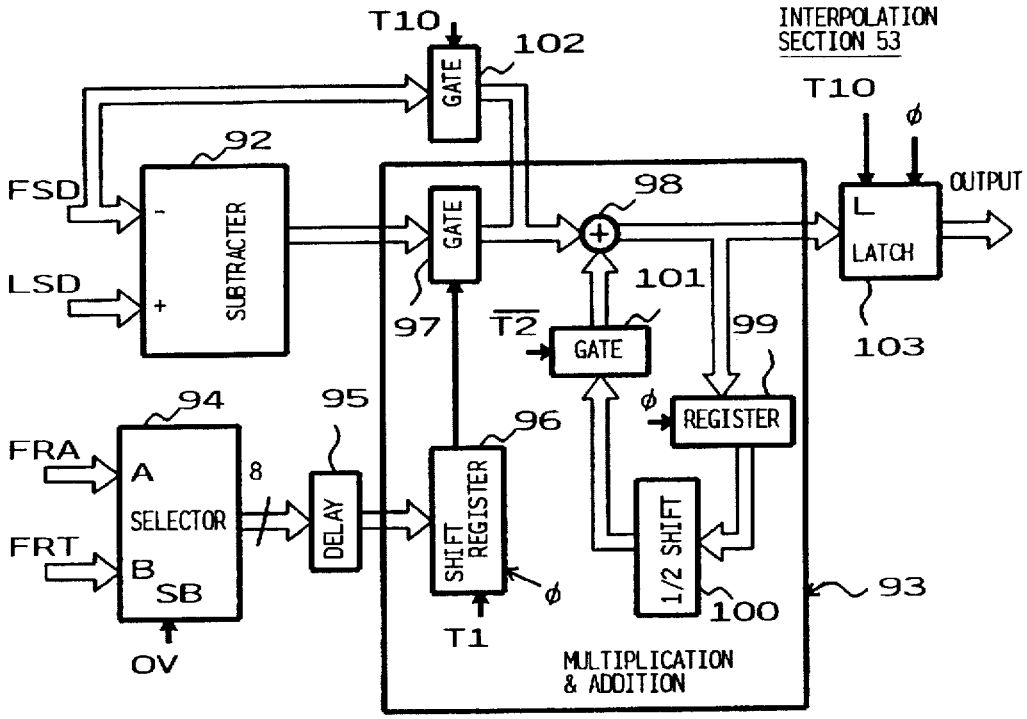
FIG. 12 is a block diagram illustrating an example detailed structure of the interpolation section shown in FIG. 5.

The first sample data FSD and second sample data LSD latched in the latches 88 and 89, respectively, are input to the interpolation section 53, detailed structure of which is illustrated in FIG. 12.

Referring now to FIG. 12, a subtracter 92 calculates a difference LSD–FSD between the first sample data FSD and the second sample data LSD. In a multiplication and addition section 93, the calculated difference LSD–FSD is multiplied by the sample address decimal fraction part FRA, and the multiplication result (LSD–FSD) FRA is then added with the first first sample data FSD. In this manner, primary interpolation operation between waveform sample points using the decimal fraction part FRA as interpolation parameter [FSD+(LSD–FSD) FRA] is performed.

In more specific terms, the decimal fraction part data FRA of the current sample data address output from the shift register 61 of FIG. 7 and the decimal fraction part data FRT output from the adder 64 of FIG. 7 for use in the loop-end processing are both applied to selector 94. This selector 94 is controlled in its selection operation by the overflow signal OV output from the latch LA4 of FIG. 7, in such a manner that, in the normal time when the overflow signal OV is "0", it selects the decimal fraction part data FRA of the current sample data at A input. Output of the selector 94 is delayed through a delay circuit 95 by a time corresponding to two channel slots. This delay is to adjust channel timing of the decimal fraction part data output from the selector 94 to channel timing in the interpolation section 53. Namely, this is because the decimal fraction part data output from the selector 94 has been delayed behind channel timing in the address generating section 50 by a time corresponding to two channel slots due to processes in the sequential delivery section 51 and sample reproduction section 52.

At the timing of process slot 1, Eight-Bit parallel decimal fraction part data output from the delay circuit 95 is supplied in parallel to a shift register 96 within the multiplication and addition section 93 in response to timing signal T1. The the decimal fraction part data FRA is sequentially serially shifted in accordance with the clock pulse signal $\phi$ and is output bit by bit starting with the lowermost bit. This shift output action starts with process slot 2, and output of all the eight bits are completed within slots 2 to 9. One-bit output signal of this shift register 96 is given as a gate-enable signal to a gate 97 to control passage therethrough of the output LSD–FSD of the subtracter 92. The gate 97 corresponds to a serial multiplier for multiplying the level difference LSD–FSD between the two sample data by the decimal fraction part data FRA.

Output of the date 97, namely, partial product data obtained by a serial multiplication is applied to a partial product addition loop which is made up of an adder 98, register 99, ½ shift circuit 100 and gate 101. When partial product data of the lowermost weight is first given from the gate 97 to the adder 98 at process slot 2, the gate 101 is made inoperative by inverted signal T2 of timing signal T2, and the partial product data of the lowermost weight is passed through the adder 98 and stored into the register 99. Then, when partial product data of the second-lowermost weight is given to the adder 98 at the next process slot 3, the partial product data of the lowermost weight output from the register 99 is properly weighted (to ½) by means of the ½ shift circuit 100 and is applied through the gate 101 to the adder 98. Thus, the partial products are added together with proper weights, and the resultant partial sum is stored into the register 99. In this manner, partial products are accumulatively added with proper weights so that, at the last process slot 9, a product (LSD–FSD) FRA is stored into the register 99.

At the next process slot 10, a gate 102 is enabled so that the first sample data FSD is passed therethrough to the adder 98. At this time, the adder 98 adds the product (LSD–FSD) FRA output from the the register 99 with the first sample data FSD, so as to obtain an interpolation operation result FSD+(LSD–FSD) FRA. This interpolation operation result FSD+(LSD–FSD) FRA is latched into a latch 103 in response to timing signal T10. Then, output of the latch 103 is given to the multiplier 54 (FIG. 5) as output waveform sample data of the interpolation section 53.

What has been described above is an interpolation process performed in the normal state. A similar interpolation operation process is carried out upon arrival at the loop end, except that the selector 94 selects the decimal fraction part data FRT for the loop-start process; that is, FRA is replaced with FRT and an interpolation operation of FSD+(LSD–FSD) FRT will be carried out.

Next, interpolation processes before and after the arrival at the loop end will be described with reference to FIG. 13.

Figure 13:
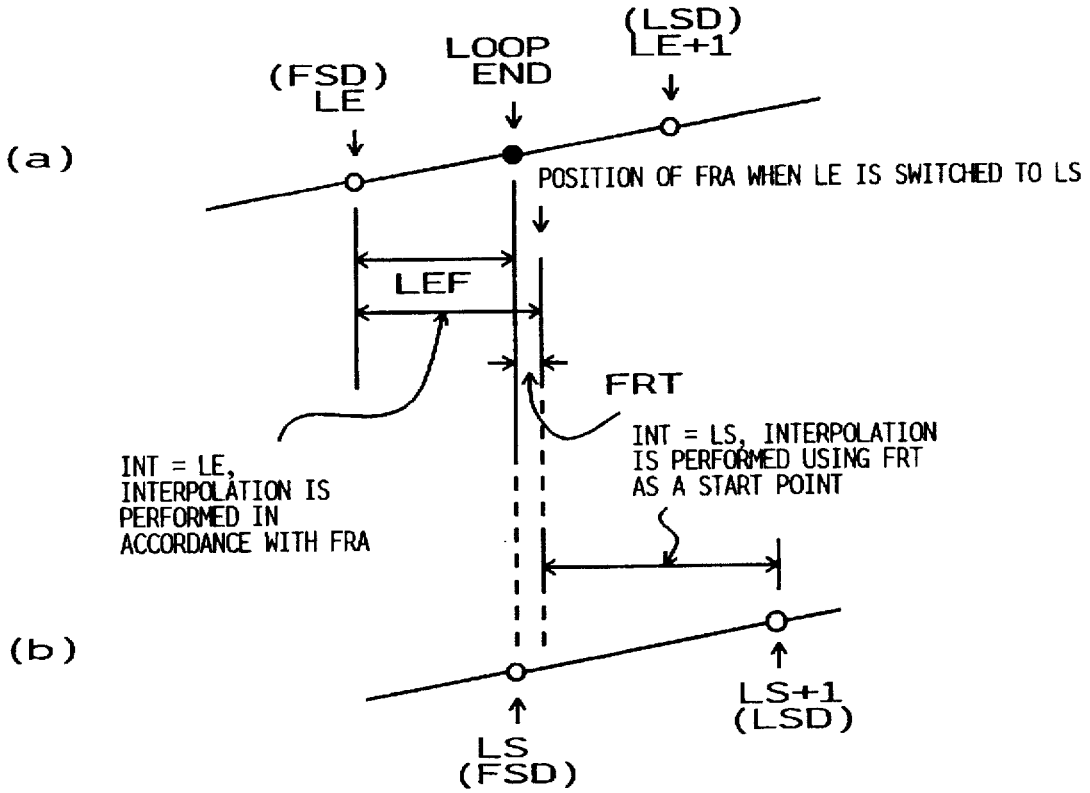
FIG. 13 is a diagram explanatory of interpolation processes carried out before and after a loop end has been reached.

In the case where the integer part INT of the current sample address is coincident with the integer part LE of the loop end address, an interpolation operation is carried out in accordance with the decimal fraction part FRA of the current sample address, using as the first sample data FSD sample data corresponding to the integer part LE of the loop end address and using as the second sample data LSD sample data corresponding to a sample address LE+1 larger by one than the loop end address integer part LE, as shown in item (a) of FIG. 13.

When the condition of FRA≧LEF has been established, i.e., the current sample address containing a decimal fraction part (INT+FRA) has arrived at the loop end address containing a decimal fraction part (LE+LEF), the integer part of the current sample address is switched to the loop start address as mentioned earlier. Further, the interpolating decimal fraction part data is switched to decimal fraction part deviation data FRA–LEF=FRT for the loop-end arrival time. Accordingly, immediately after the arrival at the loop end, the first sample data FSD is switched to sample data corresponding to the start address LS and the second sample data LSD is switched to sample data corresponding to a sample number LS+1 next to the loop start address, as shown in item (b) of FIG. 13. Then, an interpolation operation is made between the sample data in accordance with the decimal fraction part deviation data FRA–LEF=FRT.

Subsequently, when the arrival at the loop end containing a decimal fraction part is detected in the course of such a waveform sample interpolation between the first sample data FSD corresponding to the loop end address LE and the second sample data LSD corresponding to the next address LE+1, the loop end address is abandoned even in the course of the interpolation, the first and second sample data FSD, LSD are switched to the loop start address LS and sample data corresponding to the next sample number LS+1, respectively, and a new interpolation operation is initiated using the decimal fraction part deviation value FRT as an interpolation stating value. Accordingly, looped readout will be started not with sample data corresponding to the loop start address LS, but with a sample value obtained by interpolating sample data corresponding to the loop start address LS in accordance with the decimal fraction part deviation value FRT.

As may be readily understood from the foregoing, it is necessary that the ROM 18 stores therein sample data corresponding to an address LE+1 next to the loop end address LE for the interpolation purposes.

Although the tone source section 14 and CPU 15 have been shown in the above description as examples of plural systems sharing a memory, the systems may be tone forming or controlling systems. In such a case, if a memory is shared among three or more systems, a suitable preferential access or priority standard may be established and memory access control may be made of the respective systems, in order to achieve the most efficient memory access.

Further, the memory shared among three or more systems need not be physically integral but may be composed of separate components such as the ROM 18 and RAM 19 of the above-described embodiment. After all, the memory may be any memories sharing an address bus. Moreover, the memory shared may be other than an external memory.

As has been described, according to the present invention, the control section normally has access to the memory memory, but, when a utilization-request signal is given from the tone source section, the tone source section is allowed to access the memory only for a time necessary to read out tone forming data. Accordingly, the memory accessing time is not fixed and thus access to the memory can be made in a flexible manner. Particularly, the control section (comprising a computer, for instance) normally has preferential access to the memory, and gives the memory access to the tone source section only when the utilization-request signal is generated from the tone source section. Consequently, on the average, access to the memory by the control section can be done with a highly enhanced efficiency, and thus efficient memory access without waste can be achieved.

Further, in the case where the present invention is applied to plural systems other than the tone source section and the control section, predetermined one system normally has preferential access to a memory and the other system is allowed to access the memory when there is given a utilization-request signal from the other system. With this arrangement, access to the memory by the control section can be done with a highly enhanced efficiency, and thus efficient memory access without waste can be achieved a high memory access efficiency. Moreover, by allowing any one of the systems to access the memory in accordance with a predetermined preferential utilization standard determined so as to give priority to a system requiring a high memory access efficiency, it is made possible to achieve an unwasteful efficient memory access on the whole.

What is claimed is:

1. An electronic musical instrument which comprises:

storage means for storing tone forming data and operation controlling data;

a control section for reading out the operation controlling data to control an operation of circuitry on the basis thereof;

a tone source section for reading out tone forming data to form a tone signal on the basis thereof;

request signal generating means for causing a utilization-request signal to be generated from said tone source section when the tone forming data is needed; and access control means for normally allowing said control section to access said storage means, and allowing, when the utilization-request signal is given, said tone source section to access said storage means only for a time necessary to read out the tone forming data, wherein said request signal generating means causes the utilization-request signal to be generated from said tone source section during a sample time for forming tone signal sample data, when it is necessary to form the tone signal, said time necessary to read out the tone forming data is a part of one sample time, and said access control means, during a sample time when the utilization-request signal is given, allows said tone source section to access said storage means only for a part of the sample time necessary to read out the tone forming data and allows said control section to access said storage means for a remaining part of the sample time.

2. An electronic musical instrument which comprises:

storage means for storing tone forming data and operation controlling data;

a control section for reading out the operation controlling data to control an operation of circuitry on the basis thereof;

a tone source section for reading out the tone forming data to form a tone signal on the basis thereof;

request signal generating means for causing a utilization-request signal to be generated from said tone source section when the tone forming data is needed; and access control means for normally allowing said control section to access said storage means, and allowing when the utilization-request signal is given, said tone source section to access said storage means only for a time necessary to read out the tone forming data, wherein said tone source section is capable of generating tone signals independently in respective ones of plural tone generation channels, different readout times are assigned, as a time to read out the tone forming data, to the respective tone generation channels, said request signal generating means generates the utilization-request signal during the assigned readout time of the tone generation channel where it is necessary to form a tone signal, the time necessary to read out the tone forming data is a part of the assigned readout time, and said access control means, during the assigned readout time of the tone generation channel to which the utilization-request signal has been given, allows said tone source section to access said storage means only for a time necessary to read out the tone forming data and allows said control section to access said storage means for a remaining part of the time.

3. An electronic musical instrument claim 1 which comprises:

storage means for storing tone forming data and operation controlling data;

a control section for reading out the operation controlling data to control an operation of circuitry on the basis thereof;

a tone source section for reading out the tone forming data to form a tone signal on the basis thereof;

request signal generating means for causing a utilization-request signal to be generated from said tone source section when the tone forming data is needed;

access control means for normally allowing said control section to access said storage means, and allowing, when the utilization-request signal is given, said tone source section to access said storage means only for a time necessary to read out the tone forming data; and utilization-enable signal generating means for, when said control section does not access said storage means, generating a utilization-enable signal indicating that said tone source section can utilize said storage means, and in which said access control means, if the utilization-request signal is given when the utilization-enable signal is not being generated, allows said tone source section to access said storage means only for a time necessary to read out the tone forming data, during which time said access control means disables said control section from accessing said storage means.

4. An electronic musical instrument which comprises:

storage means for storing tone forming data and operation controlling data;

a control section for reading out the operation controlling data from said storage means to control an operation of circuitry on the basis thereof;

a tone source section for reading out the tone forming data from said storage means to form a tone signal on the basis thereof;

request signal generating means for generating a utilization-request signal at a predetermined deadline for the tone forming data to be read by said tone source section for forming a tone signal; and access control means for normally allowing one of said control section and said tone source section to access said storage means in such a manner that said control section has access priority over said tone source section, and allowing, when the utilization-request signal is given, said tone source section to access said storage means at least for a time necessary to read out the tone forming data.

5. An electronic musical instrument which comprises:

at least two tone synthesizing or controlling systems that operate independently of each other;

storage means for storing data in correspondence to the systems for use in respective ones of said systems;

means for, when predetermined one of said systems does not access said storage means, generating a utilization-enable signal indicating that the other of said systems can access said storage means;

means for generating a utilization-request signal when the other of said systems wants to access said storage means; and access control means for allowing the predetermined one of said systems to access said storage means when the utilization-enable signal is not being given from the predetermined one of said systems, allowing the other of said systems to access said storage means when the utilization-enable signal is given from the predetermined one of said systems, and allowing, if the utilization-request signal is given when the utilization-enable signal is not being generated, the other of said systems from which the utilization-request signal is given to access said storage means only for a time necessary to read out the data, during which time said access control means disables the predetermined one of said systems from accessing said storage means.

6. An electronic musical instrument which comprises:

at least two tone synthesizing or controlling systems that operate independently of each other;

storage means for storing data in correspondence to said systems for use in respective ones of said systems;

means for generating a utilization-request signal when said systems want to access said storage means; and access control means for, on the basis of said utilization-request signal, allowing one of said systems to access said storage means in accordance with a predetermined priority standard that varies depending on an operating condition of said systems.

7. An electronic musical instrument which comprises:

storage means for storing tone forming data and operation controlling data;

a control section for reading out the operation controlling data to control operation of circuitry on the basis thereof;

a tone source section for reading the tone forming data to form plural tone signals on the basis thereof during plural sample periods;

control signal generating means for causing a control signal to be generated from said tone source section, said control signal generating means limiting an amount of time that said control signal is generated during a sample period to an amount of time necessary to read tone forming data needed to form a tone signal; and access control means for allowing said control section to access said storage means during a sample period only when the control signal is given, and allowing said tone source section to access said storage means for a remaining part of the sample period.

8. An electronic musical instrument as defined in claim 7 in which said tone source section is capable of generating tone signals independently in respective ones of plural tone generation channels during the sample periods, different readout times are assigned, as a time to read the tone forming data, to the respective tone generation channels, said control signal generating means generates the control signal during the assigned readout time of the tone generation channel where it is necessary to form a tone signal, and the amount of time necessary to read the tone forming data is a part of the assigned readout time.

9. An electronic musical instrument as defined in claim 7 in which said control section comprises a computer for controlling an operation of the electronic musical instrument, and said operation controlling data comprises program data for said computer.

10. An electronic musical instrument as defined in claim 9 in which said access control means, when it allows said tone source section to access said storage means, instructs said computer to wait by temporarily stopping advancing a program step.

11. An electronic musical instrument which comprises:

storage means for storing tone forming data and operation controlling data;

a control section for reading out the operation controlling data to control operation of circuitry on the basis thereof;

a tone source section for reading out the tone forming data to form a tone signal on the basis thereof;

utilization-enable signal generating means for, when said control section does not access said storage means, generating a utilization-enable signal indicating that said tone source section can utilize said storage means;

utilization-request signal generating means for causing a utilization-request signal to be generated from said tone source section when tone forming data have not been read by said tone source section by a predetermined deadline; and access control means for allowing said control section to access said storage means at any time when the utilization-request signal is not given and allowing said tone source section to access said storage means only when at least one of the utilization-request signal and the utilization-enable signal is given, wherein if the utilization-request signal is given while the utilization-enable signal is not given, the access control means allows the tone source section to access said storage means and disables said control section from accessing said storage means.

12. An electronic musical instrument as defined in claim 11 which further comprises a counter for counting a number of times that said tone source section accesses said storage means, and wherein said utilization-request signal generating means determines, on the basis of a value of said counter, whether the tone forming data have been read by the predetermined deadline, and said utilization-request signal generating means generates the utilization-request signal on a basis of the determination.

13. An electronic musical instrument as defined in claim 11 in which said tone source section includes address output means for sequentially outputting addresses when said tone source section accesses said storage means and tone source data receiving means for receiving tone source data that are sequentially read from said storage means by said tone source section accessing said storage means.

14. An electronic musical instrument as defined in claim 11 in which said control section comprises a computer for controlling operation of said electronic musical instrument, and the operation controlling data comprises program data for said computer.

15. An electronic musical instrument as defined in claim 14, in which when the utilization-request signal is given, said access control means prevents said computer from accessing said storage means until the utilization-request signal is not given.

16. An electronic musical instrument which comprises:

at least two tone synthesizing or controlling systems that operate independently of each other;

storage means for storing data in correspondence to the systems for use in respective ones of said systems;

means for, when a predetermined one of said systems does not access said storage means, generating a utilization-enable signal indicating that the other of said systems can access said storage means;

means for causing a utilization-request signal to be generated by said other system when necessary data have not been read by said other system by a predetermined deadline; and access control means for allowing the predetermined one of said systems to access said storage means at any time when the utilization-request signal is not given and allowing the other of said systems to access said storage means only when at least one of the utilization-request signal and the utilization-enable signal is given, wherein if the utilization-request signal is given while the utilization-enable signal is not given, the access control means allows the other of said systems to access said storage means and disables the predetermined one of said systems from accessing said storage means.

17. An electronic musical instrument which comprises:

storage means for storing tone forming data and operation controlling data;

a control section for reading out the operation controlling data to control operation of circuitry on the basis thereof;

a tone source section having plural tone generation channels for reading out the tone forming data to form plural tone signals, wherein said tone source section generates the plural tone signals independently in respective ones of the plural tone generation channels on the basis of the tone forming data, control signal generating means for causing a control signal to be generated by said tone source section, said control signal generating means limiting an amount of time that said control signal is generated during a particular sampling period to an amount of time necessary to read tone forming data for generation of a tone assigned to a channel that corresponds to the particular sample period; and access control means for allowing said tone source section to access said storage means during a sample period only when the control signal is given, and allowing said control section to access said storage means for a remaining part of the sample period.

* * * * *